US007275450B2

(12) United States Patent
Hirai et al.

(10) Patent No.: US 7,275,450 B2
(45) Date of Patent: Oct. 2, 2007

(54) TIGHTENING TORQUE MEASURING UNIT AND TORQUE INDICATING TIGHTENING DEVICE

(75) Inventors: Tatsuo Hirai, Otsu (JP); Yasunobu Kaneyama, Osaka (JP)

(73) Assignee: Maeda Metal Industries, Ltd., Osaka (JP)

( * ) Notice: Subject to any disclaimer, the term of this patent is extended or adjusted under 35 U.S.C. 154(b) by 152 days.

(21) Appl. No.: 11/177,025

(22) Filed: Jul. 8, 2005

(65) Prior Publication Data

US 2006/0005637 A1 Jan. 12, 2006

(30) Foreign Application Priority Data

Jul. 8, 2004 (JP) ..... 2004-201316

(51) Int. Cl.
*B25B 23/14* (2006.01)

(52) U.S. Cl. ..... 73/862.21; 73/862.22; 73/862.23

(58) Field of Classification Search ..... 73/862.21, 73/862.22, 862.23
See application file for complete search history.

(56) References Cited

U.S. PATENT DOCUMENTS 5,383,370 A * 1/1995 Abramson et al. ..... 73/862.23
5,404,775 A * 4/1995 Abe ..... 81/469
5,442,965 A * 8/1995 Halen ..... 73/862.22
5,513,546 A 5/1996 Ikeda et al.
5,953,965 A * 9/1999 Kaneyama et al. ..... 81/55
5,964,128 A * 10/1999 Kaneyama et al. ..... 81/56
6,053,080 A * 4/2000 Kaneyama et al. ..... 81/469
6,868,742 B2 * 3/2005 Schoeps ..... 73/862.21

FOREIGN PATENT DOCUMENTS

| | | |
|---|---|---|
| DE | 43 07 131 A1 | 9/1994 |
| EP | 0 601 988 A1 | 6/1994 |
| JP | 52-57598 | 5/1977 |
| JP | 60-255368 | 12/1985 |
| JP | 05-256712 | 10/1993 |
| WO | WO 02/085568 | 10/2002 |

* cited by examiner

*Primary Examiner*—Edward Lefkowitz
*Assistant Examiner*—Freddie Kirkland, III
(74) *Attorney, Agent, or Firm*—David P. Maivald; Arnold B. Silverman; Eckert Seamans Cherin & Mellott, LLC

(57) ABSTRACT

A tightening torque measuring unit (4) has an inner shaft (31) connectable to a first output shaft (12) of a tightening device main body (1) and an outer shaft (32) connectable to a second output shaft (13) of the body. The inner shaft (31) is provided with a tightening socket (21), and the outer shaft (32) with a reaction force receiver (22). The outer shaft (32) has strain gauges (47), and an indicator (5) for converting an amount of strain detected by the gauges into a corresponding tightening torque value. Since the reaction force receiver (22) can be attached to the measuring unit (4), the tightening reaction force is prevented from acting to knock down the receiver (22), enabling the unit (4) to measure tightening torque, with the device main body (1), the measuring unit (4) and the socket (21) positioned in alignment with the axis of the nut to be tightened.

13 Claims, 23 Drawing Sheets

TIGHTENING TORQUE MEASURING UNIT AND TORQUE INDICATING TIGHTENING DEVICE

FIELD OF THE INVENTION

The present invention relates to a unit for measuring the tightening torque of bolt or nut tightening devices and tightening devices capable of indicating torque values.

BACKGROUND ART

The tightening torque of conventional bolt or nut tightening devices is adjusted and recognized by referring to a torque adjusting dial (indicated at 10 in FIG. 24) provided on the main body of the tightening device and manually tightening the bolt or nut additionally with a torque wrench.

Stated more specifically, the torque adjusting dial 10 is first set at a value slightly lower than the desired tightening torque value, and a bolt or nut (hereinafter referred to typically as "nut") is tightened.

Thus, a torque value serving as a rough target value is set on the dial 10 utilizing the fact that the tightening torque of the tightening device shown in FIG. 22, Graph X and the load current of the tightening device shown in Graph Y are in a nearly proportional relationship. Upon the load current reaching a target value, the motor of the tightening device ceases rotating. The actual torque at this time differs from the value set on the adjusting dial, for example, owing to the gear efficiency of the reduction mechanism incorporated in the main body of the tightening device.

Accordingly, the worker additionally tightens up the nut with a torque wrench equipped with a torque indicator to recognize the actual tightening torque.

The procedure including the manipulation of the torque adjusting dial 10, tightening of the nut by the tightening device and additional tightening of the nut with the torque wrench is repeated a number of times in order to set the dial 10 so that the actual tightening torque of the tightening device becomes the desired torque value.

The nuts used for bridges and like large steel-frame structures are large-sized, and manually using the torque wrench for tightening heavily burdens the worker. Using the torque wrench also poses many safety problems in view of the work environment where the tool is not always easily usable and which is likely to involve, for example, an elevated site and unstable scaffolding.

Accordingly, a tightening torque measuring implement 9 for use as attached to the tightening device main body 1 has been proposed as shown in FIG. 24.

The instrument utilizes the fact that the tightening torque shown in FIG. 22, Graph X and the amount of strain of the tightening device shown in Graph Z are in a generally proportional relationship.

The tightening device main body 1 has a first output shaft 12 and a second output shaft 13 which are rotatable in opposite directions to each other and are coaxially provided. The usual tightening work is conducted by attaching a tightening socket 21 to the first output shaft 12 and a reaction force receiver 22 to the second output shaft 13, engaging the socket 21 with a nut N, and positioning the reaction force receiver 22 in bearing contact with another nut or like projection (not shown) in the vicinity of the nut N.

The tightening torque measuring instrument 9 is used as connected between the first output shaft 12 of the device main body 1 and the socket 21. The instrument 9 comprises a solid shaft portion 91 provided at its base end with a square cavity 92 for a square shaft portion 12*a* of the first output shaft 12 of the device main body 1 to fit in, and has at its forward end a square rod 93 fittable into the base end of the tightening socket 21.

A strain gauge 47 is affixed to the surface of the solid shaft portion 91. The shaft portion 91 is provided therearound with a circuit board, torque indicator and battery (none shown).

The adjustment and recognition of torque of the tightening device having the instrument 9 attached thereto is done in the same manner as described above. The torque adjusting dial 10 on the device main body 1 is set at a value slightly lower than the desired torque value.

The reaction force receiver 22 is attached to the second output shaft 13 of the device main body 1, the tightening socket 21 is engaged with a nut N, the reaction force receiver 21 is cause to bear against a projection in the vicinity of the nut N, and the nut N is tightened.

The motor comes to a halt upon the value of current through the motor of the tightening device reaching a specified value. The indicator shows a tightening torque value corresponding to the amount of strain of the shaft portion 91 of the instrument 9 at this time.

The manipulation of the torque adjusting dial 10 and the tightening of the nut are repeated several times, and the dial 10 is set so that the actual tightening torque value on the indicator of the tightening device becomes the desired torque value.

Since the desired torque value can be set by manipulating the torque adjusting dial with reference to the actual tightening toque value on the indicator, there is no need for the worker to additionally tighten the nut with the torque wrench to measure the tightening torque.

This obviates all the problems as to the burden of labor for additionally tightening the nut with the torque wrench, hazard, etc.

The tightening torque measuring instrument 9 described is of the single shaft type, and there is a need to attach the reaction force receiver 22 to the second shaft 13 of the tightening device main body 1.

In the case where the tightening socket 21 is to be attached directly to the first output shaft 12 of the tightening device main body 1, a reaction force receiving arm 20 of the reaction receiver 22 is to be elongated in a direction along the axis of the tightening socket 21 by an amount corresponding to the length of the socket 21.

However, if the tightening torque measuring instrument 9 is interposed between the device main body 1 and the socket 21, the reaction receiving arm 20*a* needs to be further lengthened by an amount corresponding to the length of the instrument. This increases the distance between the second output shaft 13 of the device main body 1 on which the tightening reaction acts and the remote end of the reaction force receiving arm 20*a* in bearing contact with a counter member which is to be actually subjected to the tightening reaction force. In this case, the reaction force acting on the arm 20*a* exerts a great force in a direction to knock the arm down. Accordingly, the device main body 1, the torque measuring instrument 9 and the socket 21 to be in alignment with the axis of the nut when tightening the nut will fail to retain their axes in alignment with stability, possibly permitting the indicator to show an inaccurate torque value due to an inclination relative to the axis of the nut.

After the completion of adjustment of toque of the tightening device main body, it is usual practice to remove the instrument 9 and attach the socket 21 directly to the main body 1 for a tightening operation. It is then necessary to replace the arm of the reaction force receiver 22 by the shorter arm. Furthermore, the difference in length between the arms results in a difference in torque transmission efficiency. More specifically, the tightening torque value differs when the torque measuring instrument 9 is attached to the device main body and when the instrument is removed.

An object of the present invention is to provide a torque measuring unit and a torque indicating tightening device which are minimized in the difference in tightening torque value when the torque measuring unit is attached to the device main body and when the unit is removed.

SUMMARY OF THE INVENTION

The present invention provides a tightening torque measuring unit 4 having an inner shaft 31 connectable to a first output shaft 12 of a tightening device main body 1, and an outer shaft 32 connectable to a second output shaft 13 of the device main body, the inner shaft 31 being provided at an outer end thereof with a tightening socket 21, the outer shaft 32 being provided at an outer end thereof with a reaction force receiver 22, the outer shaft 32 having a strain gauge 47 thereon, the torque measuring unit 4 further comprising a circuit board 7 for converting an amount of strain detected by the strain gauge into a corresponding tightening torque value, and an indicator 5 for indicating the tightening toque value.

Since the tightening torque value is shown on the indicator 5 of the torque measuring unit 4, there is no need to measure torque by additionally tightening the nut with a wrench having a torque indicator.

Since the torque measuring unit 4 is provided with the reaction force receiver 22, the reaction force receiving arm 20 of the reaction force receiver 22 can be given a shorter length than when the receiver 22 is provided on the tightening device main body 1. For this reason, tightening torque can be properly measured, with the axes of the tightening device main body 1, the torque measuring instrument 9 and the tightening socket 21 arranged in alignment with the axis of the nut, and with the reaction force receiver 22 prevented from being knocked down by a tightening reaction force.

The torque measuring unit 4 may be removably attached to the tightening device main body 1. After the tightening torque of the device main body 1 is correctly set, the torque measuring unit 4 can be removed from the device main body 1, and the tightening socket 21 and the reaction force receiver 22 can be attached directly to the device main body 1. Thus, tightening work can be conducted with the tightening device reduced in weight by an amount corresponding to the torque measuring unit 4.

If the torque measuring function of the torque measuring unit 4 is incorporated into the tightening device instead of making the unit 4 removably attachable to the device main body 1, tightening work can be performed while recognizing the tightening torque at all times without necessitating labor and time for attaching the unit 4 to the device main body 1.

DETAILED DESCRIPTION OF THE INVENTION

Figure 1:
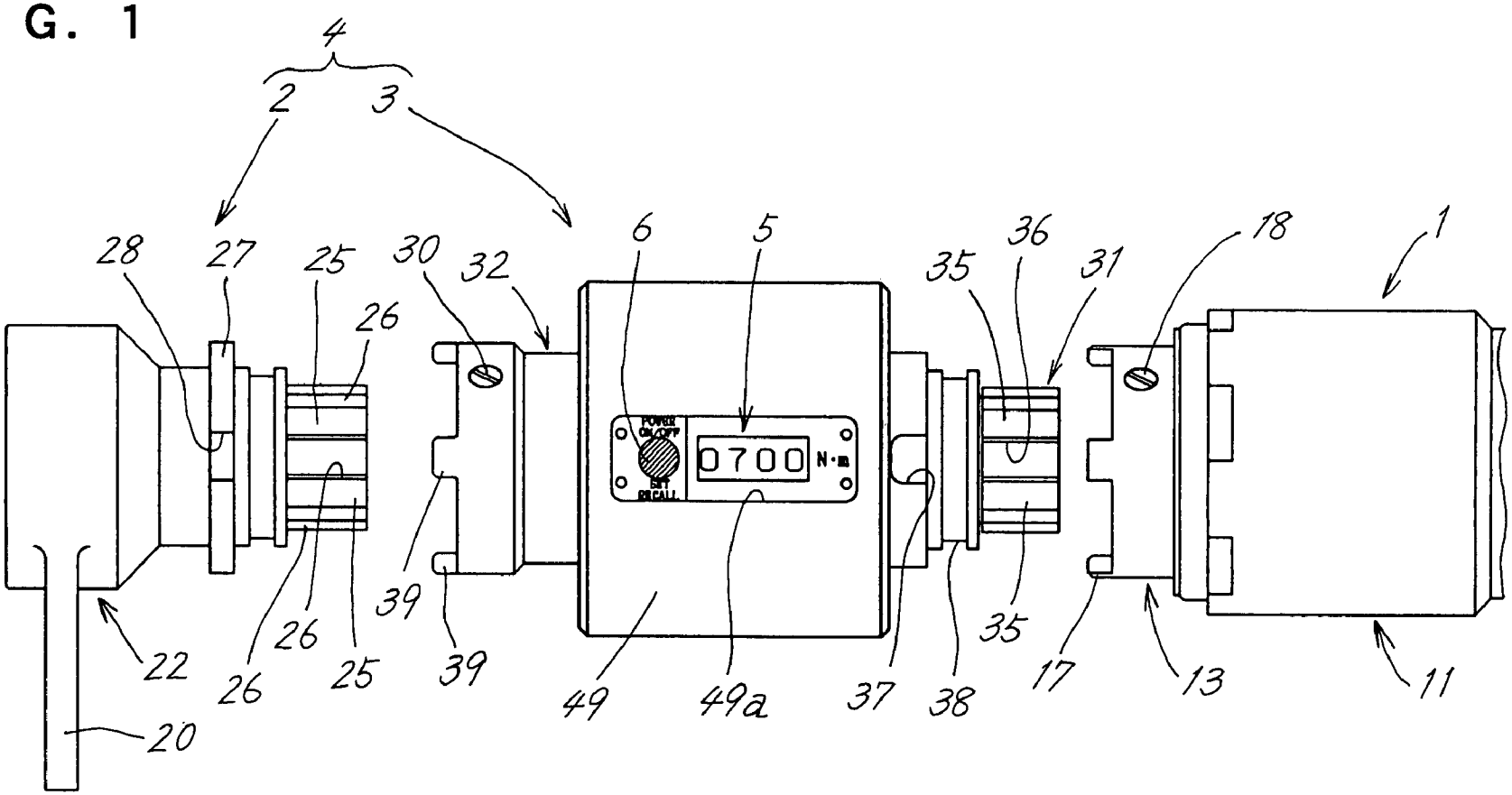
FIG. 1 is an exploded front view of a tightening torque measuring unit.

The present invention will be described below in detail with reference to the embodiments shown in the drawings.

FIRST EMBODIMENT (FIGS. 1 to 7)

Figure 2:
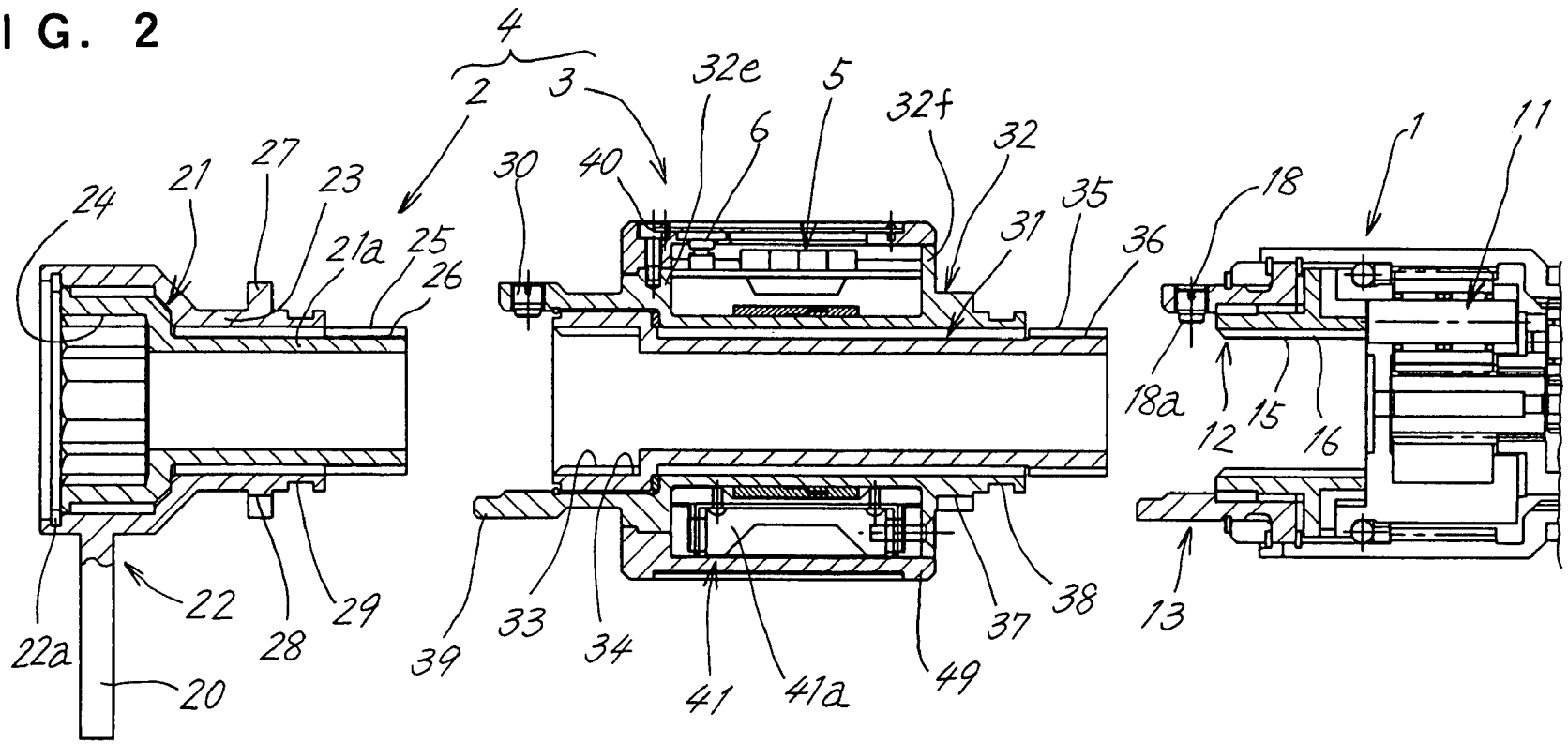
FIG. 2 is a sectional view of the same.
Figure 3:
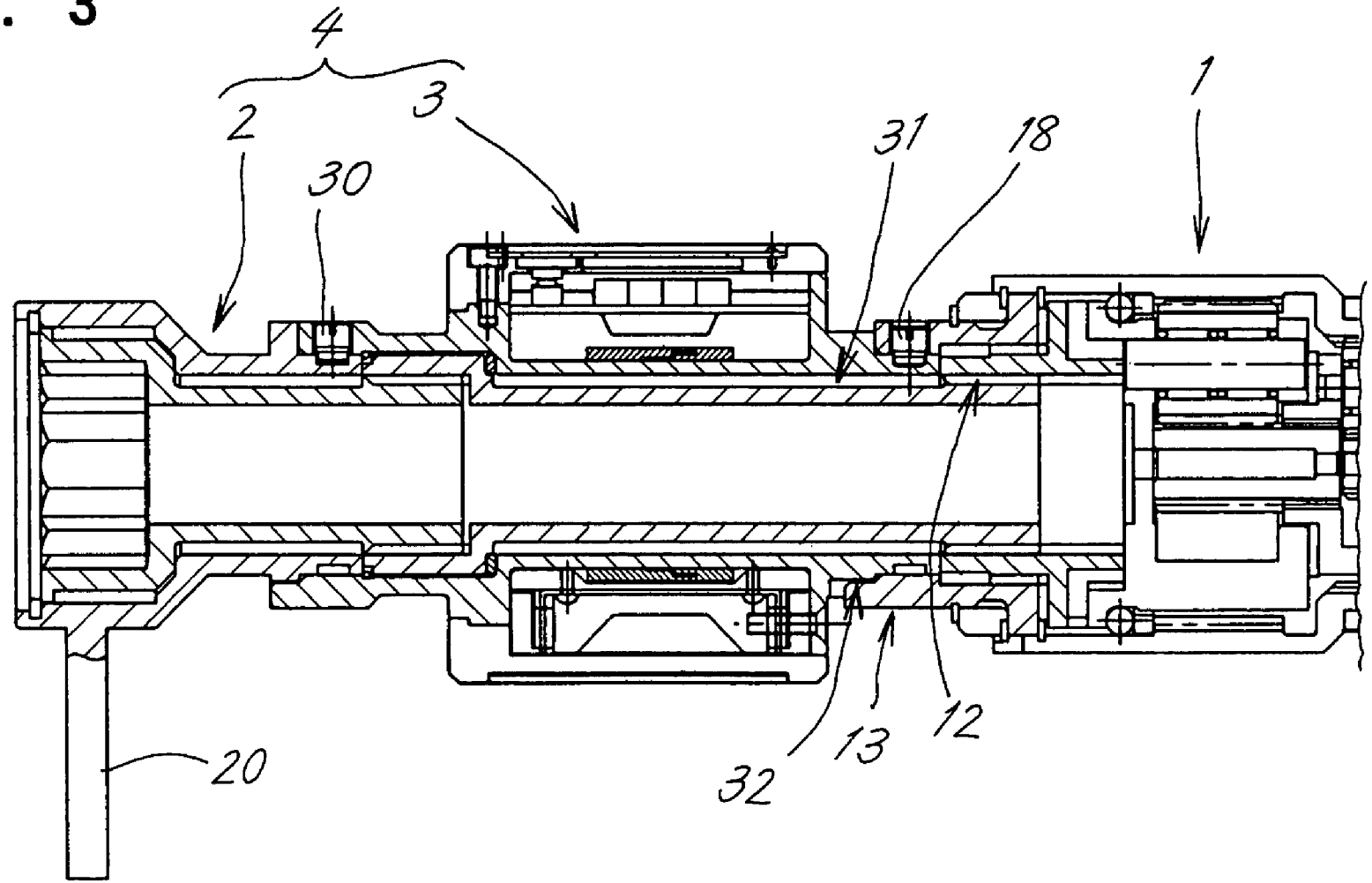
FIG. 3 is a sectional view showing the unit as attached to a tightening device main body.
Figure 4:
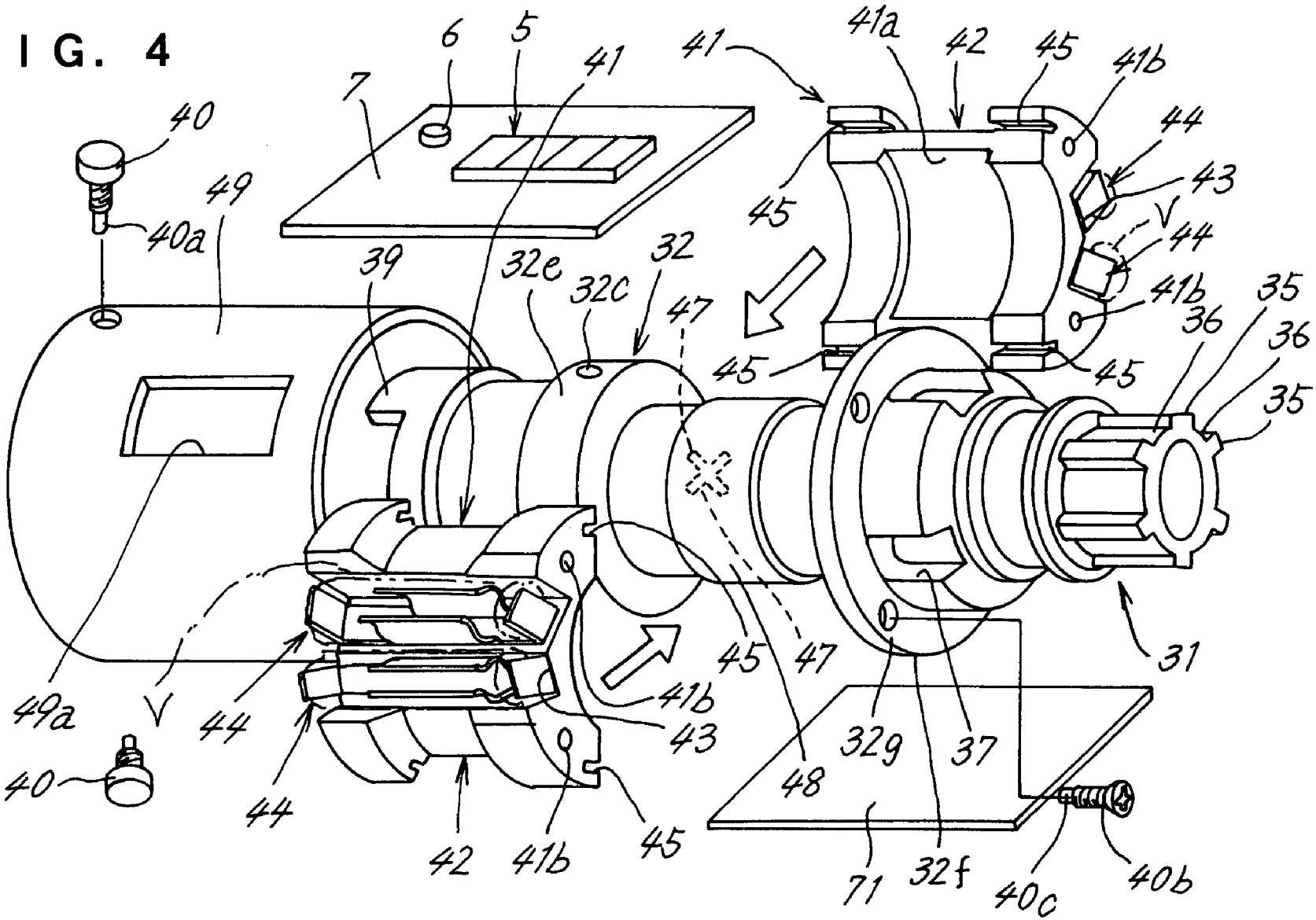
FIG. 4 is an exploded perspective view of the main body of the torque measuring unit.
Figure 5:
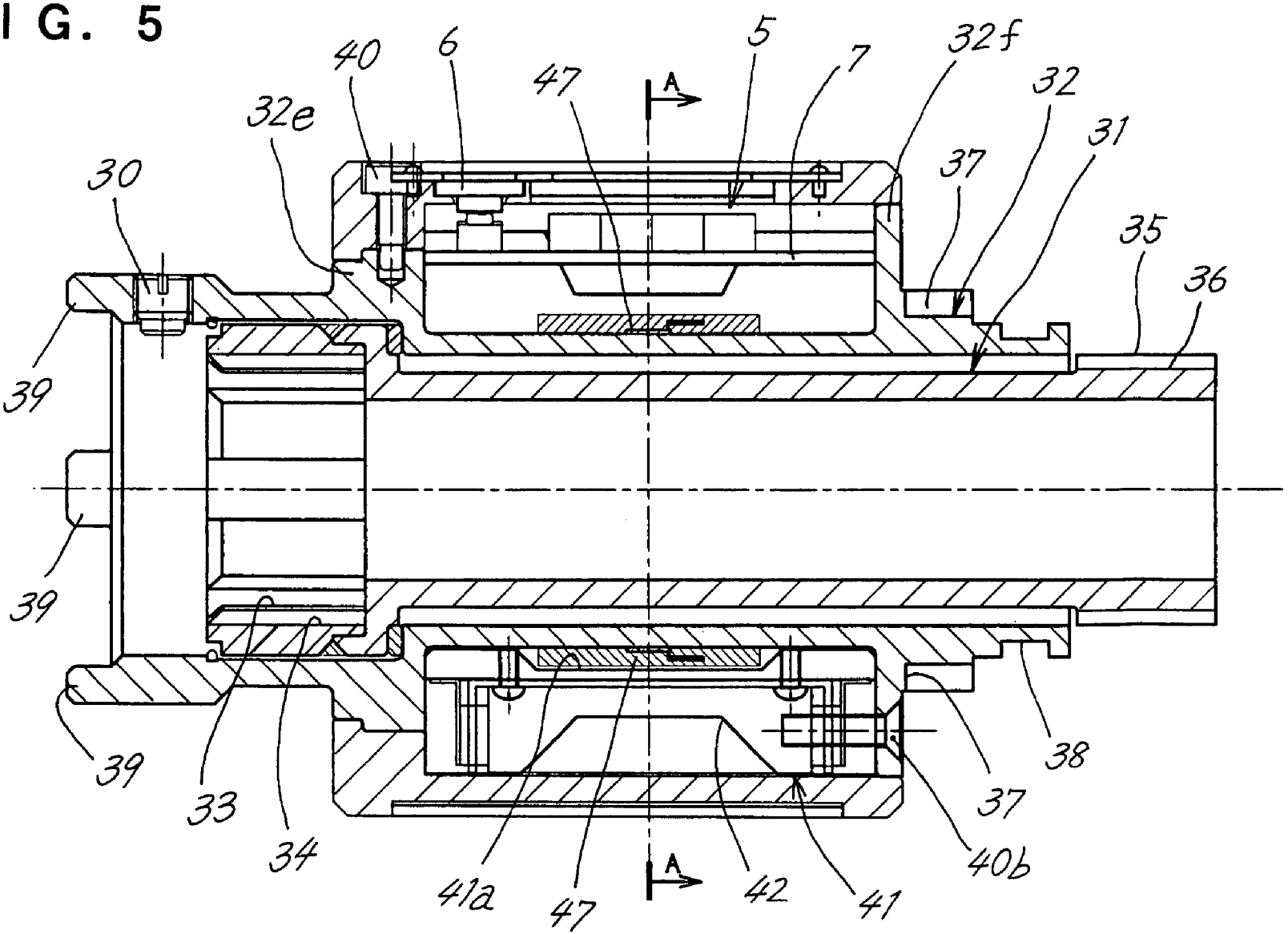
FIG. 5 is a sectional view of the torque measuring unit main body.
Figure 6:
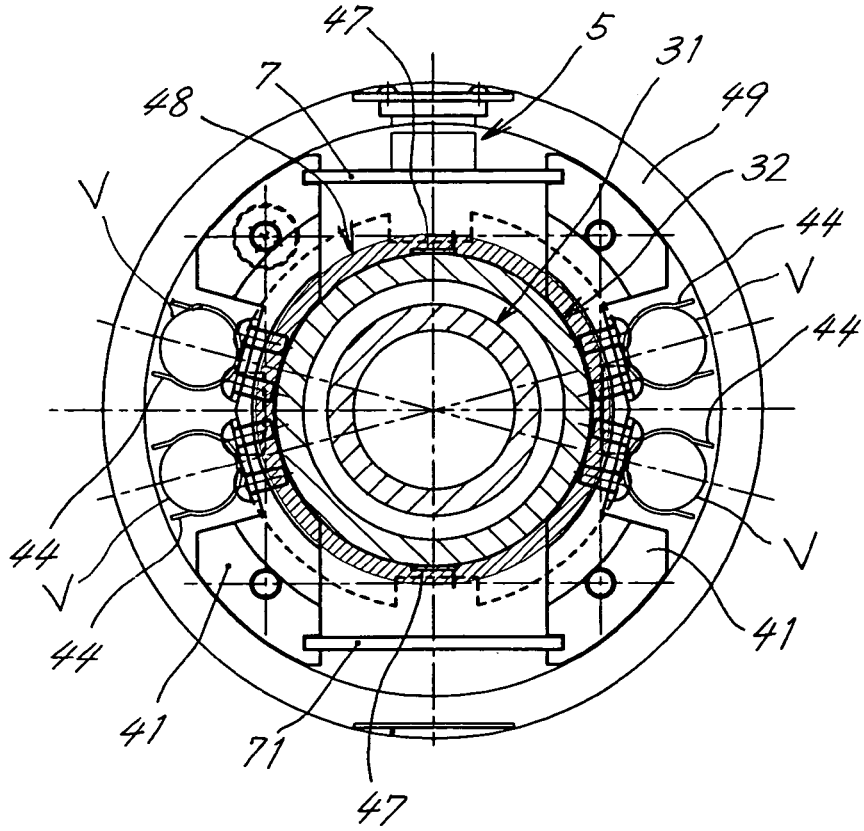
FIG. 6 is a view in section taken along the line A-A in FIG. 5.
Figure 7:
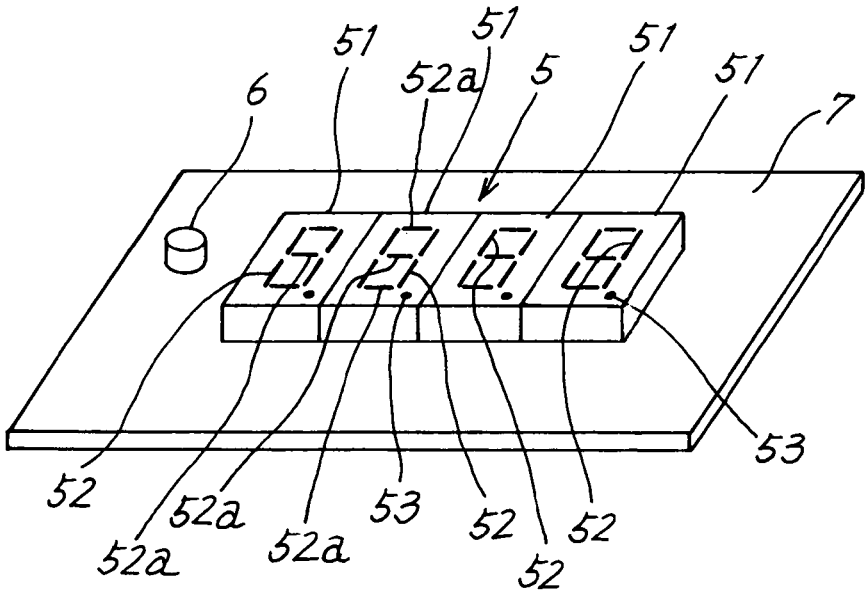
FIG. 7 is a sectional view of an indicator and a push-button switch on a circuit board.

FIGS. 1 and 2 show a tightening torque measuring unit 4 as removed from a tightening device main body 1, with the measuring unit 4 further separated into a unit main body 3 and a socket unit 2. FIG. 3 shows the torque measuring unit 4 as attached to the device main body 1.

The forward end of the device main body 1 has a tubular first output shaft 12 inside and a tubular second output shaft 12 outside which is coaxial with the shaft 12. The first and second output shafts 12, 13 are coupled to a planetary gear reduction mechanism 11 so as to rotate in opposite directions to each other.

The reduction mechanism 11 is operated by a motor (not shown) incorporated in the device main body 1.

Figure 24:
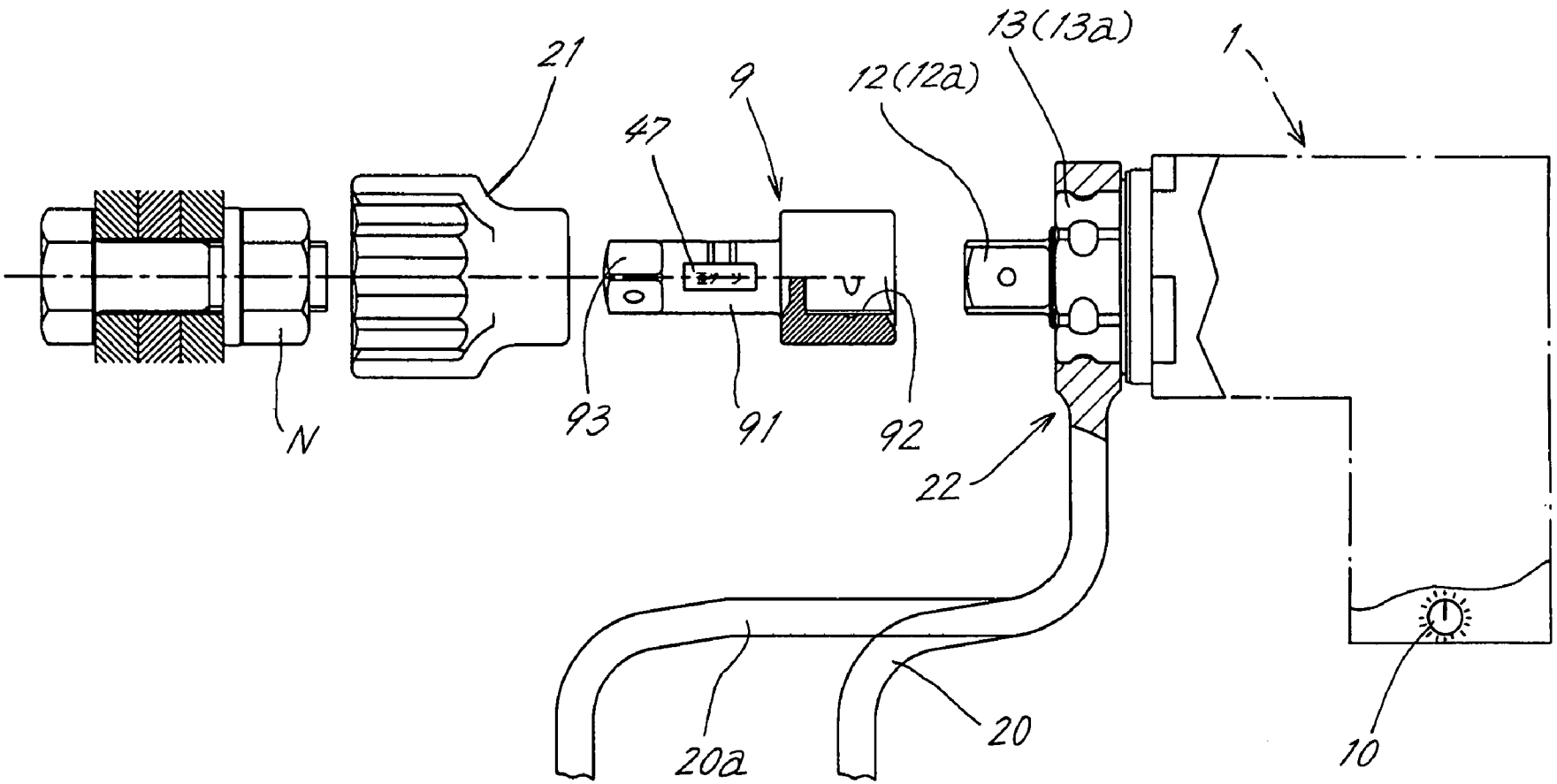
FIG. 24 PRIOR ART
FIG. 24 is a diagram showing how to use a conventional tightening torque measuring instrument.

The tightening device main body 1 has a torque adjusting dial (indicated at 10 in FIG. 24) for adjusting tightening torque. The dial utilizes the fact that the value of current through the motor and the tightening torque are in a nearly proportional relationship for adjusting the tightening torque.

The inner surface of the first output shaft 12 is provided with ridges 15 and grooves 16 extending axially of the shaft and arranged alternately circumferentially of the shaft.

The second output shaft 13 extends outward slightly beyond the first output shaft 12 and has a plurality of projections 17 arranged on the outer end edge of the shaft at equal intervals. A lock bolt 18 for the torque measuring unit 4 is screwed into an outer end portion of the second output shaft 13.

The unit main body 3 and the socket unit 2 provide the measuring unit 4.

For the usual tightening work, the tightening device is used with the socket unit 2 connected directly to the main body 1.

The socket unit 2 comprises a tightening socket 21 and a reaction force receiver 22.

The reaction force receiver 22 comprises a tubular member 23 having an enlarged outer end, and a reaction force receiving arm 20 projecting from the outer periphery of the tubular member 23 and orthogonal to the axis of the member 23.

A circumferential groove 29 for the distal end of the lock bolt 18 on the device main body 1 to fit in is formed in the base end of the tubular member 23 of the reaction force receiver 22.

The receiver 22 has a circumferential wall 27 at a small distance from the groove 29 toward the outer end thereof. Cutouts 28 for the projections 17 on the second output shaft 13 to fit in are formed in the circumferential wall 27.

The tightening socket 21 has a tubular shaft portion 21*a* rotatably fitted in the tubular member 23 of the receiver 22. The tubular shaft portion 21*a* has an enlarged outer end portion having a nut engaging cavity 24.

The tubular shaft portion 21*a* of the socket 21 has a base end projecting from the tubular member 23 of the reaction force receiver 22. The projecting portion has an outer periphery which is provided with ridges 25 and grooves 26 extending axially of the socket 21 and arranged alternately circumferentially thereof. The grooves 26 and the ridges 25 are fittable to the ridges 15 and grooves 16 of the first output shaft 12 of the device main body 1.

When a snap ring 22*a* is removed from inside the outer end of the tubular member 23 of the receiver 22, the socket 21 is removable toward the front from the receiver 22. Accordingly, the socket 21 is replaceable by other tightening socket having a nut engaging cavity 24 of different size.

The unit main body 3 has a tubular inner shaft 31 and a tubular outer shaft 32 rotatably housing the inner shaft 31 therein coaxially therewith.

The inner shaft 31 has a base end projecting from the base end of the outer shaft 32. The projecting portion has an outer periphery which is provided with grooves 36 and ridges 35 extending axially of the shaft 31 and arranged alternately circumferentially thereof. The grooves 36 and the ridges 35 are fittable to the ridges 15 and grooves 16 of the first output shaft 12 of the device main body 1.

A circumferential groove 38 for the end of the lock bolt 18 on the device main body 1 to fit in is formed in the outer periphery of base end of the outer shaft 32. Cutouts 37 for the projections 17 on the second output shaft 13 of the main body 1 to fit in are formed in a thick wall portion of the outer shaft 32 closer to the outer end thereof than the groove 38.

The outer shaft 32 has an outer end which is so sized as to fit around the base end of the tubular member 23 of the reaction receiver 22 and which has a lock bolt 30 screwed therein and fittable in the circumferential groove 29 in the tubular member 23. The edge of the outer end of the shaft 32 is provided with projections 39 arranged at equal intervals circumferentially thereof and fittable in the respective cutouts 28 in the tubular member 23.

Two circumferential walls 32*e*, 32*f* are formed around the outer shaft 32 and positioned toward the respective ends thereof. The wall 32*e* has a smaller outside diameter and a larger thickness than the other wall 32*f*. Bores 32*c* are formed in the periphery of the wall 32*e* of small diameter for preventing the tubular case 49 to be described later from slipping off. Four screw holes 32*g* extend through the other wall 32*f* of large diameter and arranged at equal intervals circumferentially of the wall.

Strain gauges 47 are affixed to the surface of the outer shaft 32 at the midportion between the circumferential walls 32*e*, 32*f*.

According to the present embodiment, the strain gauge 47 is arranged at each of four portions of the outer shaft 32 arranged at equal intervals circumferentially of the shaft 32.

The gauges 47 are covered with a protective layer 48 provided around the shaft 32 one turn.

Between the walls 32*e*, 32*f*, the outer shaft 32 has two blocks 41, 41 of identical shape arranged as opposed to each other with the outer shaft 32 positioned therebetween.

Each of the blocks 41 has an inner surface in the form of a circular-arc surface along the outer shaft 32 and an outer surface in the form of a circular-arc surface having a diameter slightly smaller than the outside diameter of the circumferential wall 32*f* of large diameter on the outer shaft 32.

A grooved portion 41*a* is formed in the inner surface of the block 41 to avoid interference with the protective layer 48.

The block 41 is provided in its outer periphery with a circumferential groove 42, and W-shaped recessed portions 43 extending in the axial direction across the groove 42.

The circumferential groove 42 serves as a passage for wiring connecting the strain gauges 47 to the circuit boards 7, 71 (to be described below) to extend therethrough.

A case 44 for a battery V is attached to each of the W-shaped recessed portions 43.

The blocks 41, 41 have screw bores 41*b* formed in their end faces and corresponding to the four screw holes 32*g* in the large-diameter circumferential wall 32*f* on the outer shaft 32. Each of the blocks 41 is fastened to the wall 32*f* with two screws 40*b*.

Two circuit boards 7, 71 are arranged between the respective opposed pairs of end faces of the blocks 41, 41.

For supporting, each of the circuit boards 7, 71 has its end edges fitted in grooves 45, 45 formed in each opposed pair of end faces of the blocks 41, 41.

One of the circuit boards, 7, is provided with an indicator 5 for showing a tightening torque value corresponding to the amount of strain of the strain gauges 47, and a push-button switch 6 for energizing the circuit boards 7, 71.

The indicator 5 of the embodiment provides a four-digit indication. Each of digit display areas 51 is adapted to express the numerals of "0" to "9" with four vertical and three horizontal light bars 52, 52*a* to be turned on. A dot portion 53 which goes on to show a dot "•" is provided at the left lower corner of each digit display area 51. LEDs (not shown) are arranged for the respective light bars 52, 52*a* and dot portions 53.

The aforementioned tubular case 49 is provided around both circumferential walls 32*e*, 32*f* on the outer shaft 32. The screws 40 extend through one end of peripheral wall of the case 49 in screw-thread engagement therewith and have threadless ends fitted in the engaging bores 32*c* of the small-diameter wall 32*e*. No thrust of screws 40 acts on the circumferential wall 32*e*.

In corresponding relation with the indicator 5 and push-button switch 6 on the circuit board 7, a window 49*a* is formed in the case 49. The switch 6 can be pushed from outside the case 49.

The strain gauges 47 provided at four locations on the outer shaft 32 constitute a bridge circuit (not shown) on the circuit board 7, and the indicator 5 shows a tightening torque value corresponding to an average amount of strain of the four portions of the outer shaft 32 where the respective strain gauges are affixed.

As shown in FIG. 3, the tightening socket 21 and the reaction force receiver 22 of the socket unit 2 are connected respectively to the inner shaft 31 and the outer shaft 32 of the unit main body 3 to provide the tightening measuring unit 4.

The base end of the inner shaft 31 of the unit 4 is fitted to the first output shaft 12 of the tightening device main body 1, the base end of the outer shaft 32 of the unit 4 is inserted into the tubular second output shaft 13 of the device main body 1, and the projections 17 on the shaft 13 are fitted into the respective cutouts 37 in the outer shaft 32.

In this way, the first output shaft 12, the inner shaft 31 of the unit main body 3 and the tightening socket 21 are connected together so as to rotate together. The second output shaft 13, the outer shaft 32 of the unit main body 3 and the reaction receiver 22 of the socket unit 2 are connected so as to rotate together in opposite direction to the rotation of the first output shaft 12.

For the adjustment and recognition of the torque of the tightening device thus having the tightening torque measuring unit 4 attached thereto in this way, the torque adjusting dial 10 on the device main body 1 is set at a value slightly lower than the desired torque value.

The push-button switch 6 of the torque measuring unit 4 is pushed to energize the circuit boards 7, 71.

The reaction force receiver 22 is attached to the second output shaft 13 of the device main body 1, the tightening socket 21 is engaged with a nut, and the reaction force receiver 22 is placed in bearing contact with a projection positioned in the vicinity of the nut.

When the motor of the device main body 1 is energized, the first output shaft 12 alone rotates since the second output shaft 13 is restrained from rotating by the reaction force receiver 22.

The motor ceases rotating upon the value of current through the motor of the tightening device reaching a specified value. At this time, the strain of the outer shaft 13 of the torque measuring unit 4 is detected by the strain gauges at the four locations, and an average value of strain is shown on the indicator 5.

The same reaction force receiver 22 can be used when the torque measuring unit 4 is attached to the device main body 4 or removed therefrom. This eliminates the need to prepare two kinds of reaction force receivers 22 which are different in the length of arm, as conventionally required.

According to the present embodiment, the connection between the outer shaft 32 having the strain gauges 47 affixed thereto and the device main body 1, and the connection between the outer shaft 32 and the socket unit 2 are effected by the fitting engagement between the ridges and the grooves both extending in the axial direction, or the fitting engagement of projections 17, 29 with the cutouts 37, 28 which extend in the axial direction, namely, by the fitting engagement of projecting portions and recessed portions which extend in the axial direction. Accordingly, tightening of the nut does not produce great differences in the amount of strain of the outer shaft 32 with respect to the circumferential direction. However, the screw thrust of the lock bolts 18, 30, if acting on the outer shaft 32, will impair the reliability of measurement, so that according to the embodiment, the strain gauges 47 arranged at four portions of the outer shaft 32 at equal intervals in the circumferential direction are used for measuring the amount of strain, and the average of the strain measurements is displayed to ensure enhanced reliability of measurement.

The provision of strain gauges 47 on the outer shaft 47 is not limited to four locations as in the embodiment but can be two, four or six locations, which are a multiple of 2 in number. The greater the number of strain gauges, the higher the accuracy of measurement of tightening torque.

In view of the circumferential length of the outer shaft 32 of the measuring unit 4 in conformity with the size of the bolt or nut tightening device to be held by the worker for use, and the degree of accuracy required of the bolt or nut tightening torque, it is desirable that strain gauges be provided at four portions.

The accuracy of torque measurement required is not so high as to provide the strain gauge at six or more portions, whereas the provision of the strain gauge at two locations is not desirable from the viewpoint of reliable torque measurement.

Since the tightening torque value is shown on the indicator 5 of the torque measuring unit 4 as described above, there is no need to additionally tighten the nut with a torque wrench equipped with a torque indicator conventionally used.

The reaction force receiving arm 20 is provided on the reaction force receiver 22 fitting around the tightening socket 21 so as to extend outward from the same position as the nut to be tightened. Accordingly, it is unlikely that the tightening reaction force acting on the arm 20 will act to knock down the unit 4 or device main body 1, with the result that the nut can be tightened with the axis of the unit 4 in alignment with the axis of the nut for the indicator 5 to show a tightening torque value which is correct to the greatest possible extent.

The manipulation of the torque adjusting dial 10 on the device main body 1 and the nut tightening operation are repeated several times to set the dial 10 so that the actual tightening torque value shown on the indicator 5 of the torque measuring unit 4 will be the desired torque value.

The same reaction force receiver 22 is usable when the measuring unit 4 is attached to the device main body 1 and when the unit 4 is removed therefrom. This obviates the need to prepared two kinds of reaction force receivers 22 which are different in the length of the arm as conventionally required.

The above procedure is preformed for a plurality of nuts to ensure the reliability of torque setting, the measuring unit 4 is thereafter removed from the device main body 1, and the socket unit 2 of the measuring unit 4 is connected directly to the device main body 1. Stated more specifically, the grooves 26 and the ridges 25 of the tightening socket 21 of the socket unit 2 are fitted to the ridges 15 and the grooves 16 of the first output shaft 12 of the device main body 1, and the base end of the reaction force receiver 22 is fitted to the second output shat 13 to engage the projections 17 on the shaft 13 in the respective cutouts 28 in the receiver 22.

When the socket unit 2 is connected directly to the device main body 1 as described above, the tightening device is usable for tightening the nut with a weight reduction corresponding to the weight of the unit main body 3 of the measuring unit 4. With torque adjustment made for the device main body 1, the tightening socket 21 automatically ceases rotating after tightening up the nut with a set torque value.

According to the embodiment, the inner shaft 31 of the unit main body 3 of the torque measuring unit 4 is tubular and is therefore reduced in weight, while even if the bolt has an excessive length (with a bolt end projecting beyond the top of the nut), the bolt end can be allowed to escape inside the shaft 13.

Figure 8:
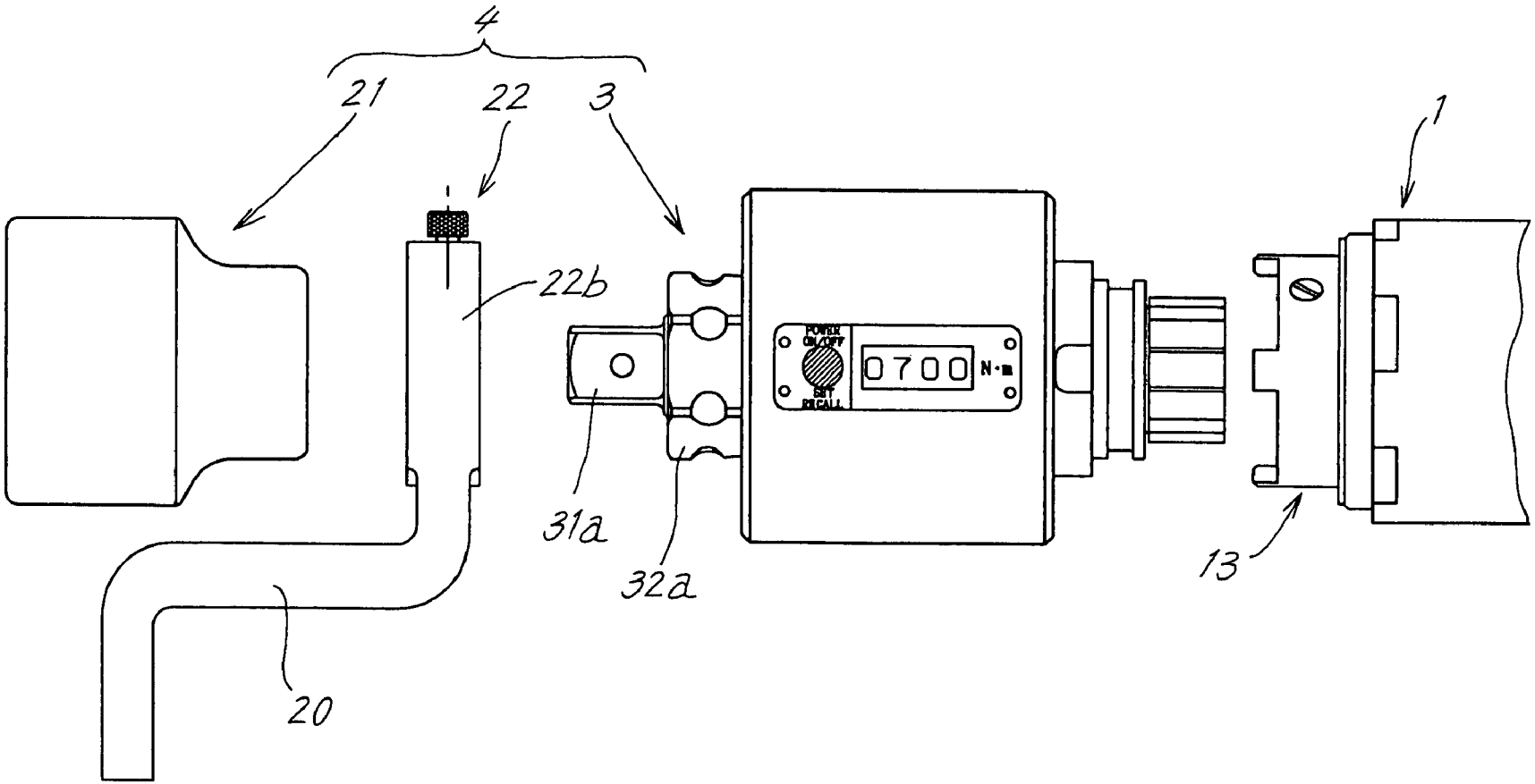
FIG. 8 is an exploded front view of a second embodiment of tightening torque measuring unit.
Figure 9:
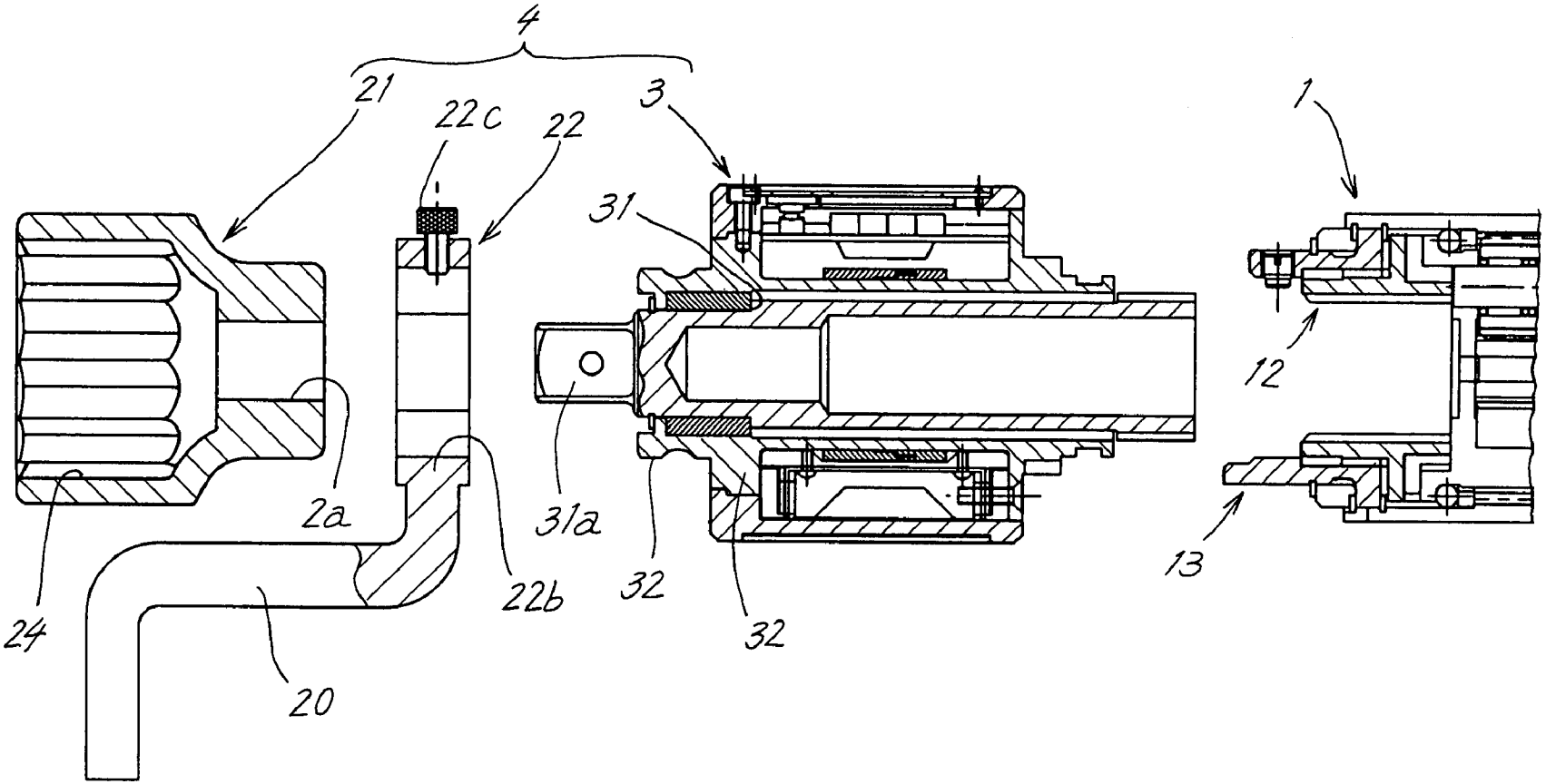
FIG. 9 is a sectional view of the same.
Figure 10:
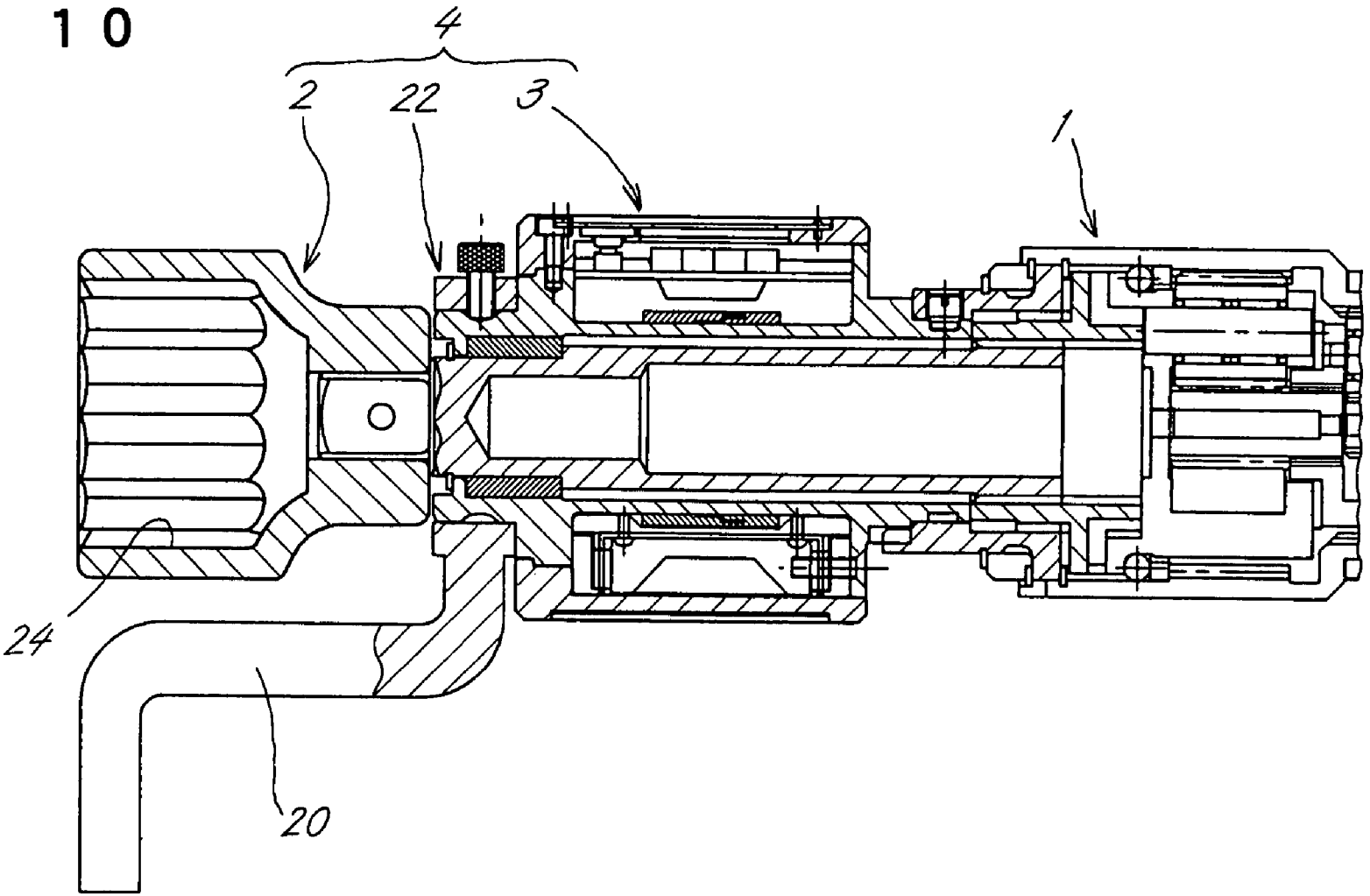
FIG. 10 is a sectional view showing the unit as attached to the tightening device main body.

SECOND EMBODIMENT (FIGS. 8 to 10)

FIGS. 8 and 9 show a tightening torque measuring unit 4 as removed from the tightening device main body 1, and the unit 4 is shown as separated into a unit main body 3, tightening socket 21 and reaction force receiver 22. FIG. 10 shows the measuring unit 4 as attached to the device main body 1.

The device main body 1 is the same as the one already described.

The unit main body 3 of the torque measuring unit 4 differs from that of the first embodiment with respect to the outer ends of an inner shaft 31 and an outer shaft 32. The other components are the same as in the first embodiment.

The outer end of the outer shaft 32 of the unit main body 3 is in the form of a short polygonal shaft portion 32*a*, which is a hexagonal shaft portion according to the second embodiment.

The inner shaft 31 of the unit main body 3 has a closed outer end, which rotatably extends through the polygonal shaft portion 32*a* of the outer shaft 32. The outer end has a square rod 31*a*.

The tightening socket 21 has a nut engaging cavity 24 at its outer end and a square bore 2*a* formed in its base end and coaxial with the cavity 24. The square rod 31*a* at the outer end of the inner shaft 31 of the unit main body 3 removably fitted in the square bore 2*a*.

The reaction receiver 22 comprises a ring 22*b* and a reaction force receiving arm 20 projecting from the outer periphery of the ring 22*b*.

The ring 22*b* fits around the polygonal shaft portion 32*a* of the outer shaft 32 of the unit main body 3 so as to be rotatable therewith. A clamp bolt 22*c* extends through a portion of the ring 22*b* in screw-thread engagement therewith for preventing slipping off.

The reaction force receiving arm 20 extends from the ring 22*b* to the outer end of the socket 21 and is bent outward approximately at a right angle.

The arm 20 of the reaction force receiver 22 extends in a direction along the axis of the socket 21 longer than in the first embodiment by a length corresponding to the length of the socket 21. This impairs the stability with which the axes of the socket 21, the unit main body 3 and the device main body extend in alignment. However, as compared with the conventional case shown in FIG. 24 wherein the reaction force receiver 21 is attached to the device main body 1 as positioned further away from the torque measuring instrument 9 as connected to the device main body 1, the length of the arm 20 along the axis of the socket 21 can bed made shorter to ensure increased stability during tightening.

With the unit main body 3 removed from the device main body 1, the socket unit 2 of the first embodiment can be attached directly to the device main body 1 to conduct nut tightening work in the usual manner.

Figure 11:
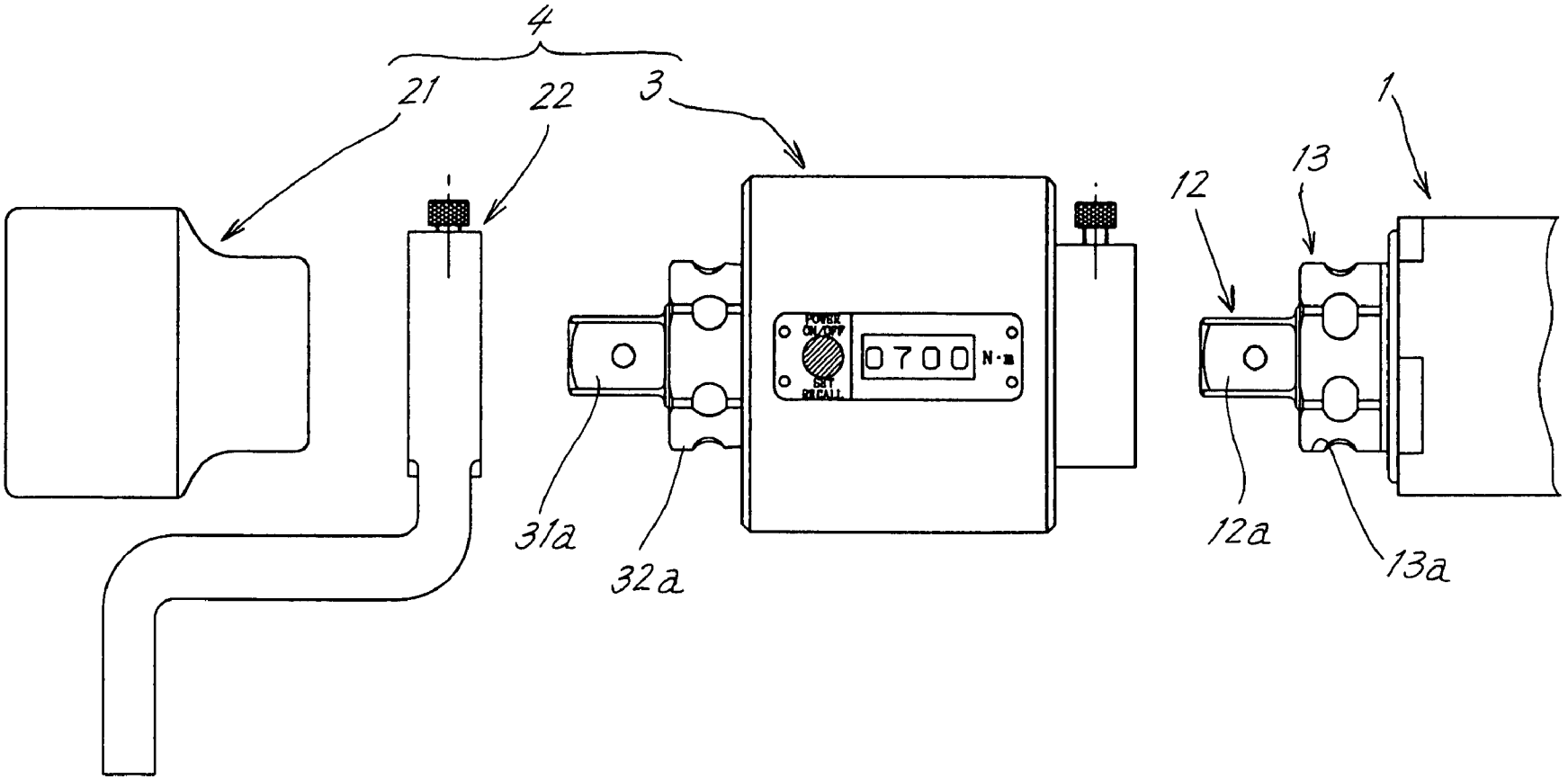
FIG. 11 is an exploded front view of a third embodiment of tightening torque measuring unit.
Figure 12:
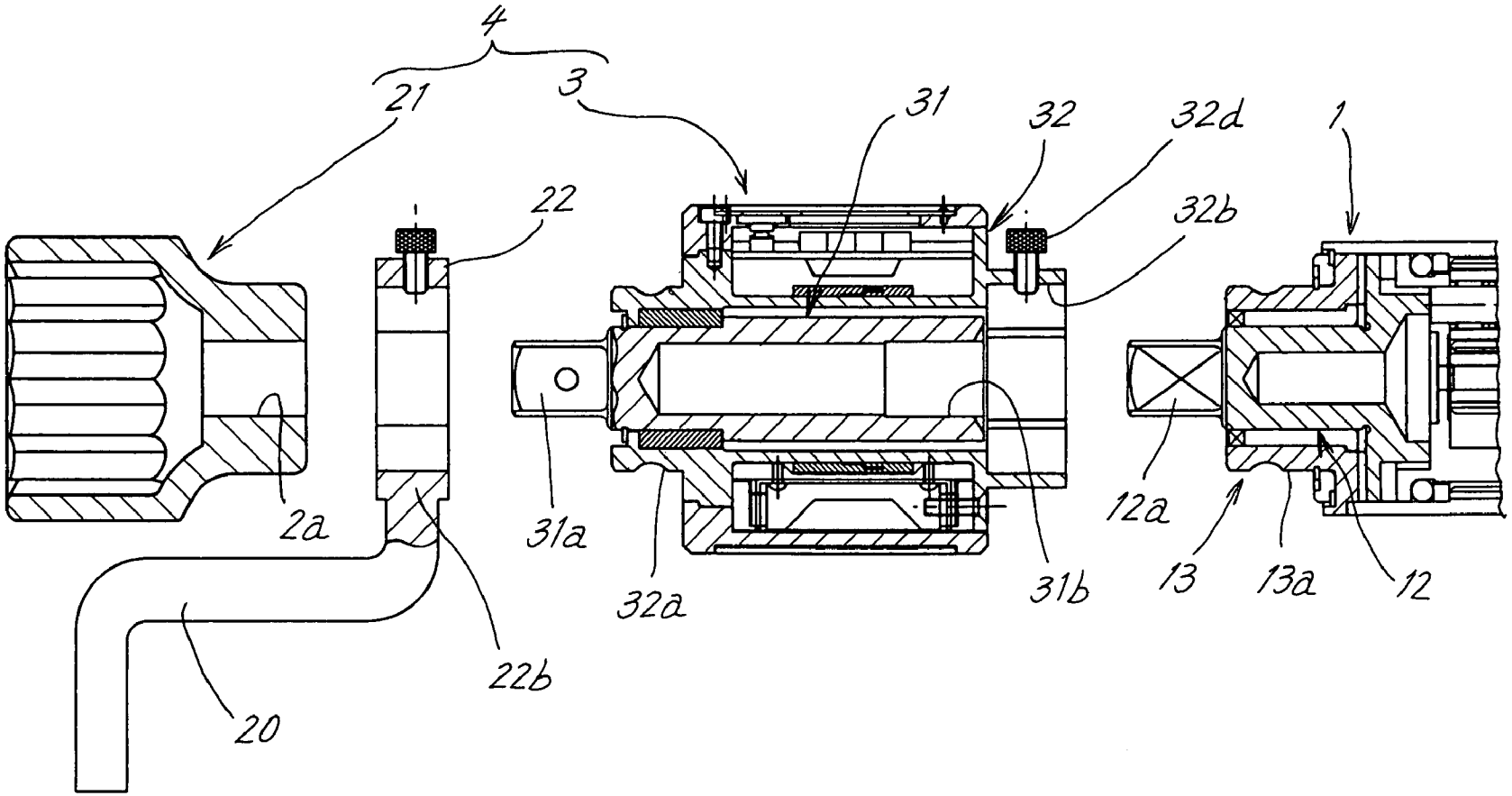
FIG. 12 is a sectional view of the same.
Figure 13:
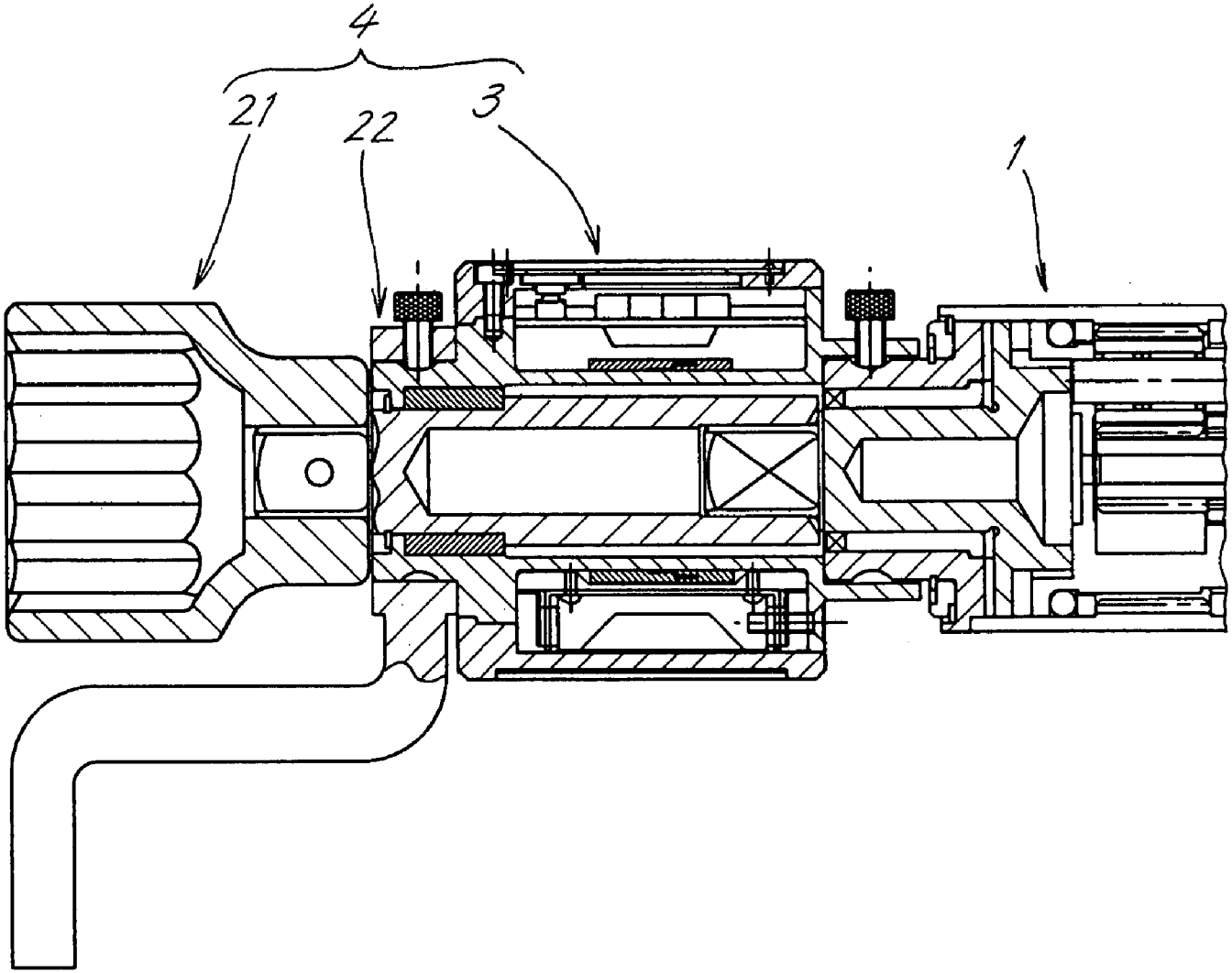
FIG. 13 is a sectional view showing the unit as attached to the tightening device main body.

THIRD EMBODIMENT (FIGS. 11 to 13)

FIGS. 11 and 12 show a tightening torque measuring unit 4 as removed from the tightening device main body 1, and the unit 4 is shown as separated into a unit main body 3, tightening socket 21 and reaction force receiver 22. FIG. 13 shows the measuring unit 4 as attached to the device main body 1.

The unit main body 3, socket 21 and reaction force receiver 22 are connected in the same relation as in the second embodiment described.

The unit main body 3 is attached to the device main body 1 in a manner different from those in the first and second embodiments.

The second output shaft 13 of the device main body 1 has an outer end portion in the form of a polygonal shaft portion 13*a*. The first output shaft 12 of the device main body 1 has a closed outer end, which rotatably extends through the polygonal shaft portion 13*a* of the second output shaft 13 and provides a projecting square rod 12*a*.

The unit main body 3 has an outer shaft 32 having an engaging cavity 32*b* formed in its base end. The polygonal shaft portion 13*a* of the second output shaft 13 of the device main body 1 is fittable into the cavity 32*b*. A clamp bolt 32*b* for preventing slipping off extends through the peripheral wall defining the cavity 32*b* in screw-thread engagement therewith.

The unit main body 3 has an inner shaft 31 which is provided at its base end with a square bore 31*b* for fitting thereinto the square rod 12*a* at the outer end of the first output shaft 12 of the device main body 1.

A ring 22*b* of the reaction force receiver 22 is fitted around the polygonal shaft portion 32*a* of the outer shaft 32 of the unit main body 3 so as to be rotatable therewith and the square rod 31*a* of the inner shaft 31 is fitted into a square bore 2*a* of the tightening socket 21 to perform usual nut tightening work.

Figure 14:
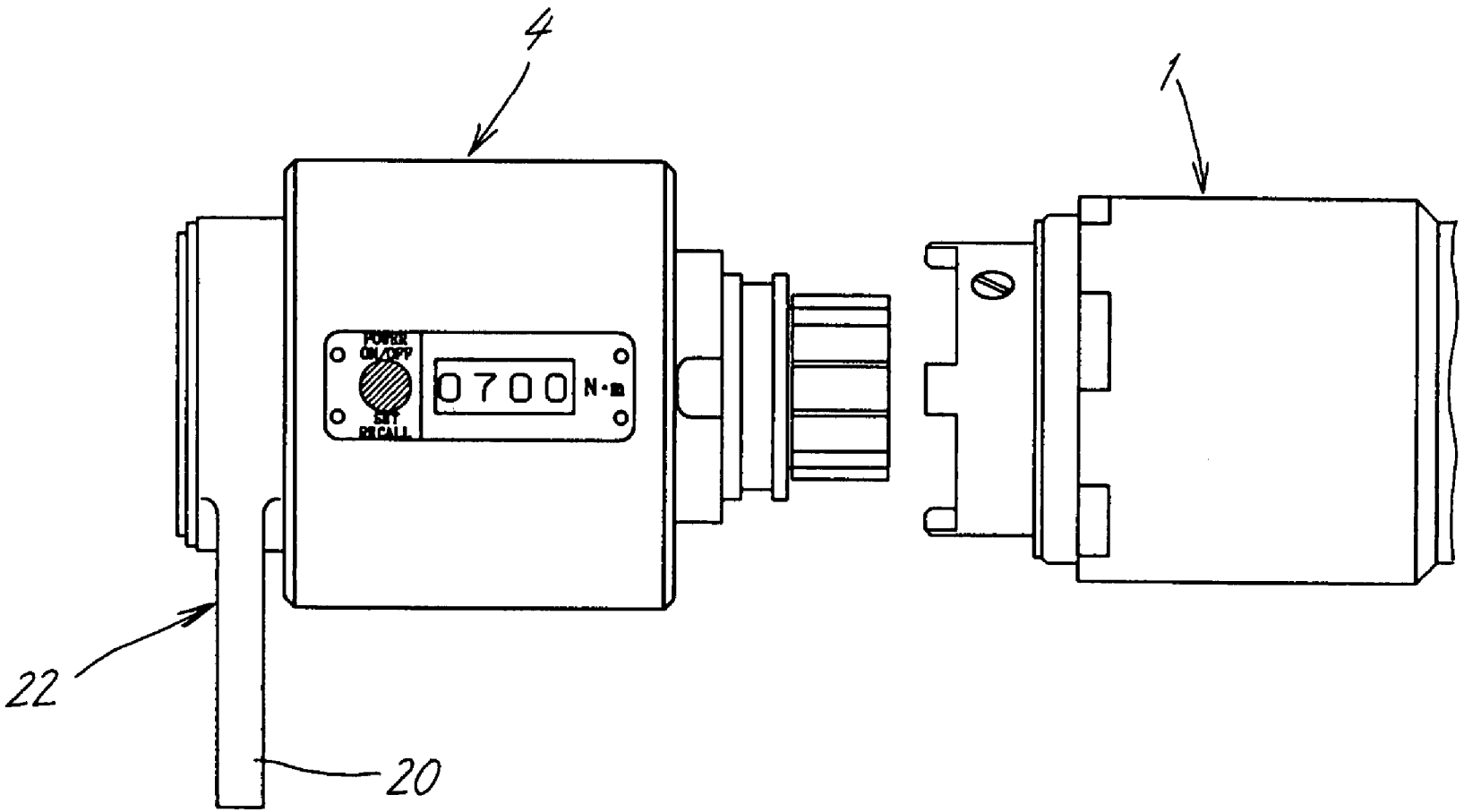
FIG. 14 is a front view showing a fourth embodiment of tightening torque measuring unit as removed from the tightening device main body.
Figure 15:
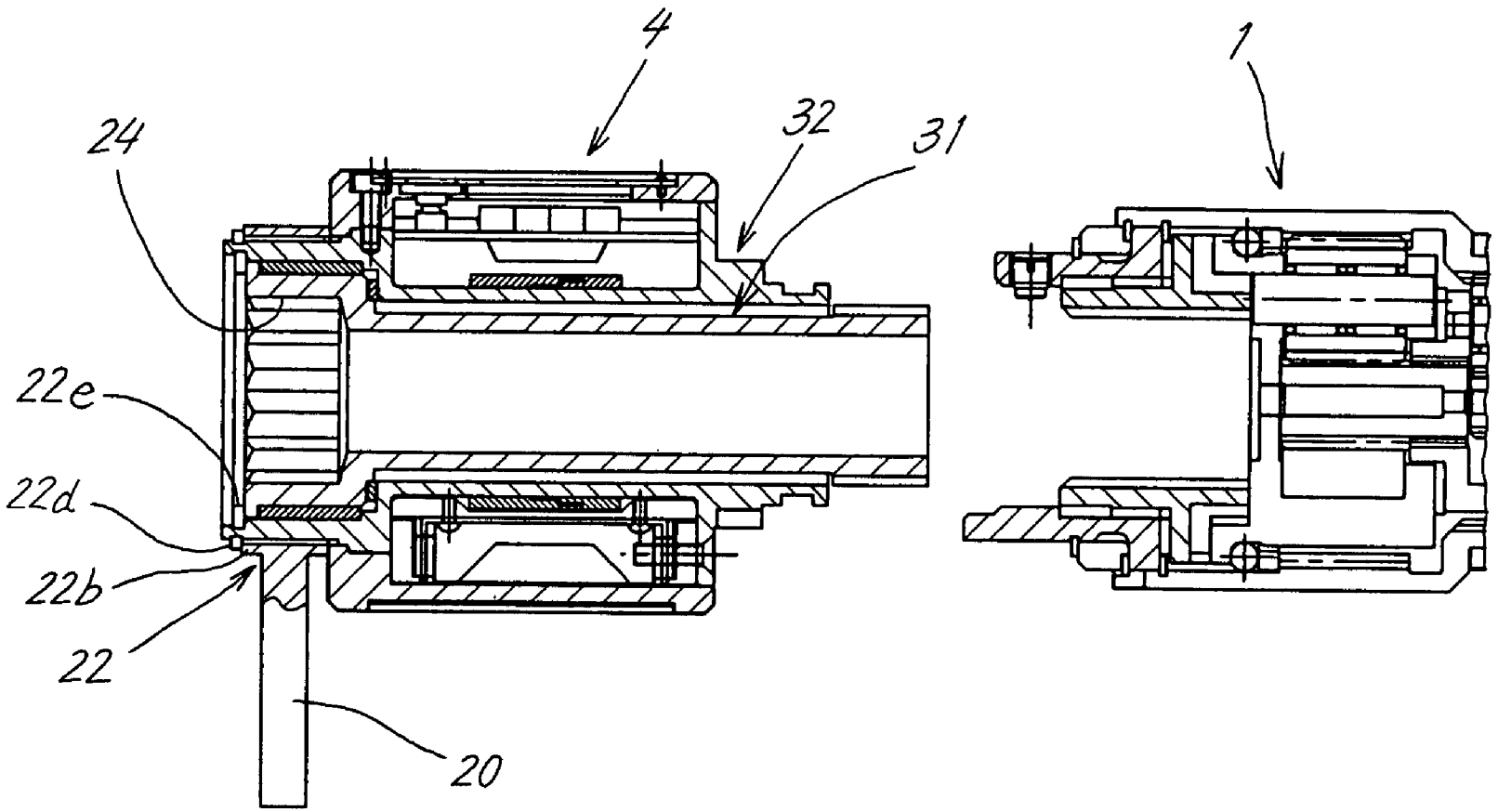
FIG. 15 is a sectional view of the same.
Figure 16:
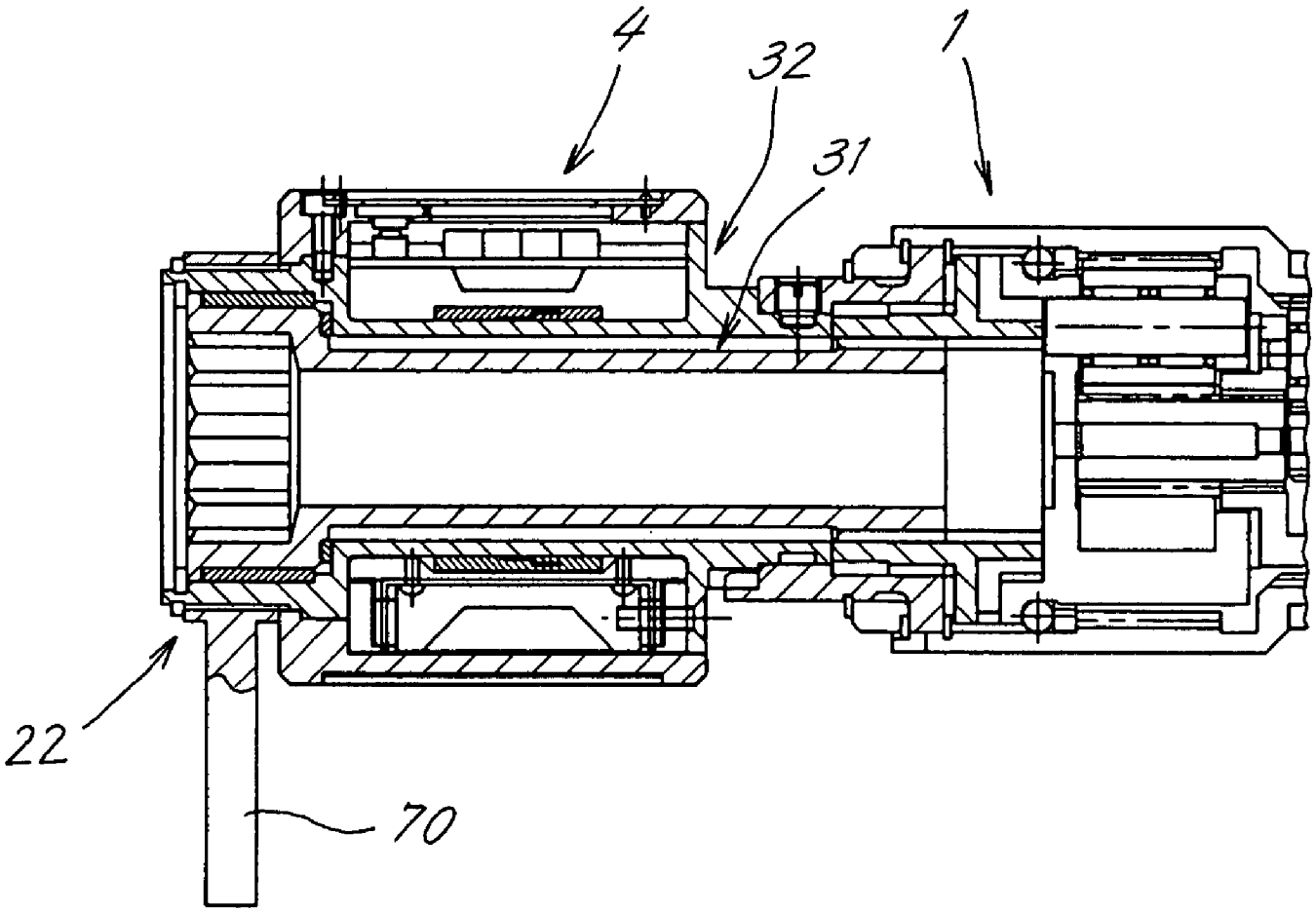
FIG. 16 is a sectional view showing the unit as attached to the tightening device main body.

FOURTH EMBODIMENT (FIGS. 14 to 16)

FIGS. 14 and 16 show a tightening torque measuring unit 4 as removed from the tightening device main body 1, and FIG. 16 shows the unit 4 as attached to the device main body 1.

The torque measuring unit 4 is attached to the device main body 1 in the same manner as in the first and second embodiments.

The unit 4 has an inner shaft 31 having an enlarged outer end provided with a nut engaging cavity 24.

A snap ring 22*e* for preventing the inner shaft 31 from slipping off is fitted in the outer end of an outer shaft 32. The inner shaft 31 is replaceable by other shaft 31 having a nut engaging cavity 24 of different size.

The outer periphery of outer end of the outer shaft 31 of the unit 4 is splined by being provided with ridges and grooves extending axially thereof and arranged alternately circumferentially thereof.

A reaction force receiver 22 is attached to the outer end of the outer shaft 32.

The receiver 22 comprises a ring 22*b* fittable around the outer end of the outer shaft 32, and a reaction force receiving arm 20 extending outward from the ring 22*b*. The ring 22*b* has an inner periphery provided with grooves and ridges engageable with the ridges and grooves of the outer shaft 32, whereby the receiver 22 and the outer shaft 32 are made rotatable together.

The reaction force receiver 22 is removable from the outer shaft 32 when a snap ring 22*d* is removed.

When the ridges and grooves of the receiver 22 are fitted to the splined outer end outer periphery of the outer shaft 32, i.e., to the grooves and ridges of the outer end thereof, the reaction force delivered to the arm 20 can be allowed to act uniformly on the entire periphery of the outer shaft 32, enabling the strain gauges 47 to detect the amount of strain accurately to the greatest possible extent since the shaft 32 is free from uneven strain.

When the usual tightening work is to be performed after the torque setting of the device main body 1 using the fourth embodiment, the unit 4 is removed, and the socket unit 2 shown in FIG. 1 is attached to the tightening device main body 1.

Figure 17:
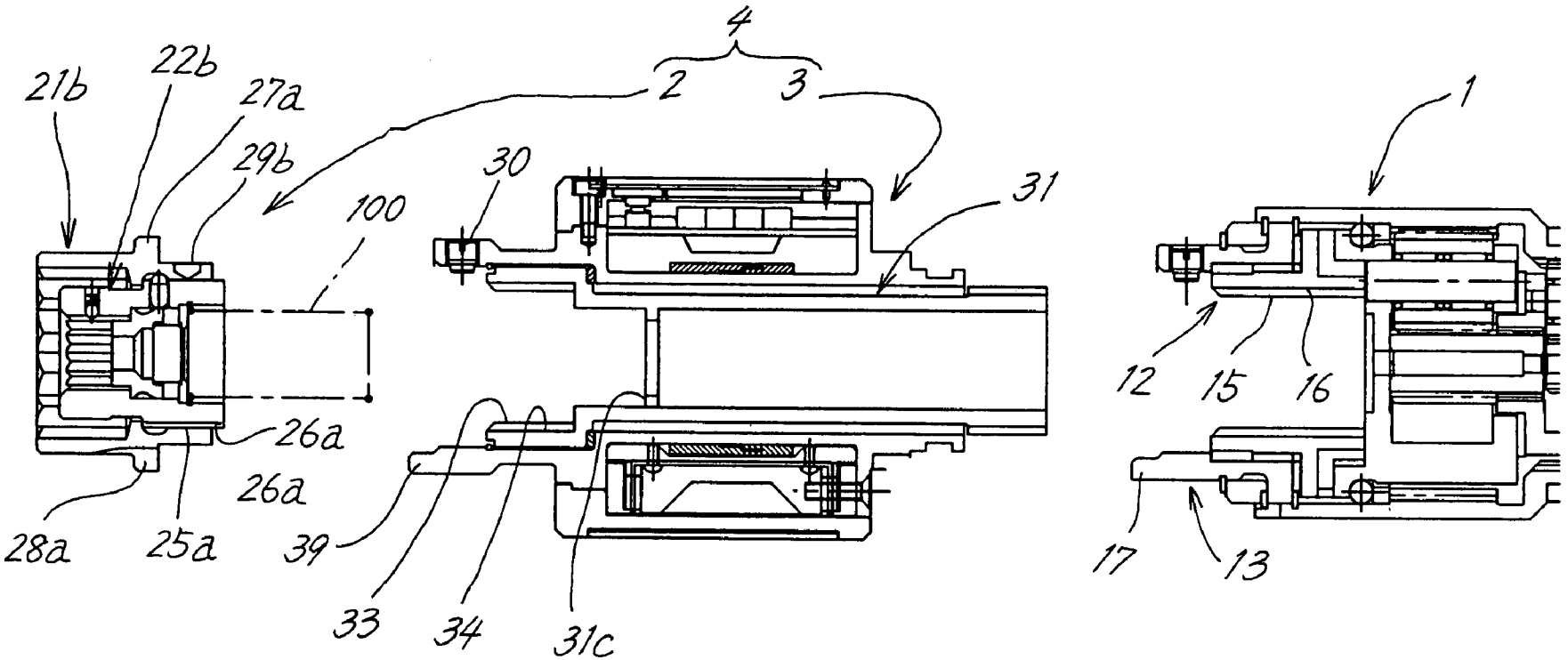
FIG. 17 is a front view showing a fifth embodiment of tightening torque measuring unit as removed from the tightening device main body.
Figure 18:
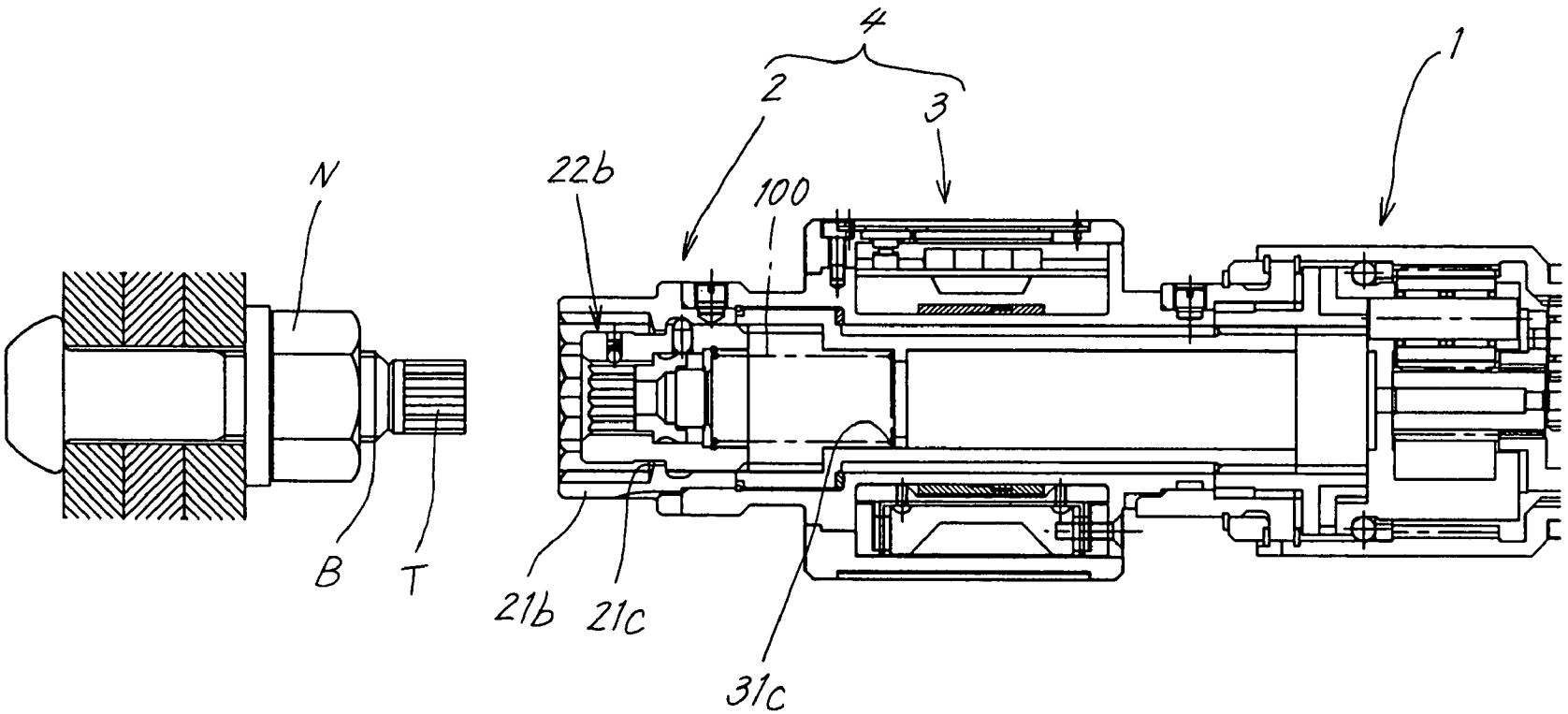
FIG. 18 is a sectional view of the same.
Figure 19:
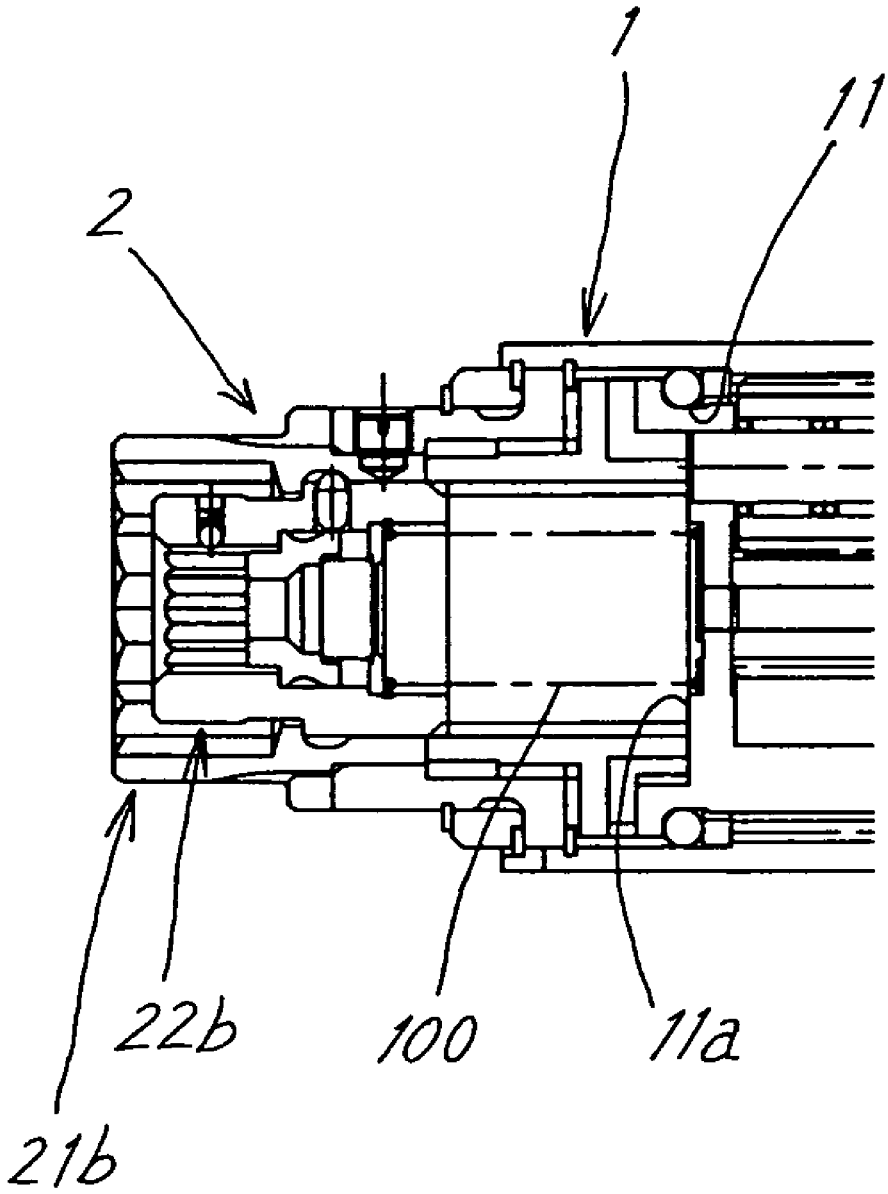
FIG. 19 is a sectional view of a socket unit as connected directly to the tightening device main body.

FIFTH EMBODIMENT (FIGS. 17 to 19)

FIG. 17 shows a tightening torque measuring unit 4 as removed from the tightening device main body 1, and FIG. 18 shows the unit 4 as attached to the device main body 1.

As shown in FIG. 18, the fifth embodiment is adapted for use with a tightening device for tightening a nut N on a bolt B having a tip T to be sheared or for receiving a reaction force.

The connection between the torque measuring unit 4 and the device main body 1, and the measuring unit 4 itself are the same as in the first embodiment.

The socket unit 2 to be removably connected to the outer end of a unit main body 3 comprises a nut engaging socket 21*b* engageable with the nut, and a bolt tip engaging socket 22*b* rotatably provided in the socket 21*b* and engageable with the bolt tip T.

The nut engaging socket 21*b* is provided at its base end with a hole, circumferential groove or recess 29*a* for the end of the lock bolt 18 of the device main body 1 or the lock bolt 30 of the unit 4 to fit in.

The nut engaging socket 21*b* has a circumferential wall 27*a* positioned a short distance closer to the outer end thereof than the recess 29*a*. The wall 27*a* has cutouts 28*a* for the projections 17 on the second output shaft 13 of the device main body 1 or projections 39 on the unit main body 39 to fit in.

The bolt tip engaging socket 22*b* has a base-end outer periphery which is provided with grooves 26*a* and ridges 25*a* extending axially thereof and arranged alternately circumferentially thereof. The grooves 26*a* and the ridges 25*a* are fittable to the ridges 15 and grooves 16 of inner periphery of the first output shaft 12 of the device main body 1 or to ridges 33 and grooves 34 of outer end of inner shaft 31 of the unit main body 3.

As shown in FIG. 18, the nut engaging socket 21*b* and the bolt tip engaging socket 22*b* of the socket unit 2 are joined to the outer shaft 32 and the inner shaft 31 of the unit main body 3 to provide the torque measuring unit 4. The unit 4 is connected to the device main body 1 in the same manner as already described.

Indicated at 100 in FIG. 18 is a spring provided between a ridge 31*c* on the inner periphery of inner shaft 31 of the unit main body 3 and the bolt tip engaging socket 22*b* for biasing the socket 22*b* forward into contact with an inner peripheral stepped portion 21*c* of the nut engaging socket 21*b*.

The tightening device is operated with the bolt tip T engaged in the socket 22*b* and with the nut N engaged with the socket 21*b*.

The rotation of the second output shaft 13 of the device main body 1 causes the outer shaft 32 of the unit main body 3 to rotate the nut engaging socket 21*b* of the socket unit 2 to tighten the nut N.

The reaction force of tightening is delivered through the first output shaft 12 of the device main body 1, inner shaft 31 of the unit main body 3 and the bolt tip engaging socket 22*b* of the socket unit 2 and received by the bolt B.

With the progress of tightening, the amount of projection of the bolt shank from the nut N increases, whereas the bolt tip engaging socket 22*b* retracts against the spring 100, causing not trouble to the tightening operation.

When the nut is tightened on the bolt with torque before shearing off the bolt tip T, the bolt tip engaging socket 22*b* in engagement with the bolt tip T serves as a reaction force receiver.

When the bolt tip T is sheared off, the nut engaging socket 21*b* in engagement with the nut N serves to receive the reaction force.

FIG. 19 shows the socket unit 2 as connected directly to the tightening device main body 1. The usual tightening work following tightening torque setting is performed in the state shown in FIG. 19. The spring 100 biasing the bolt tip engaging socket 22*b* bears, for example, on the planetary gear reduction mechanism 11*a* of the device main body 1.

Figure 22:
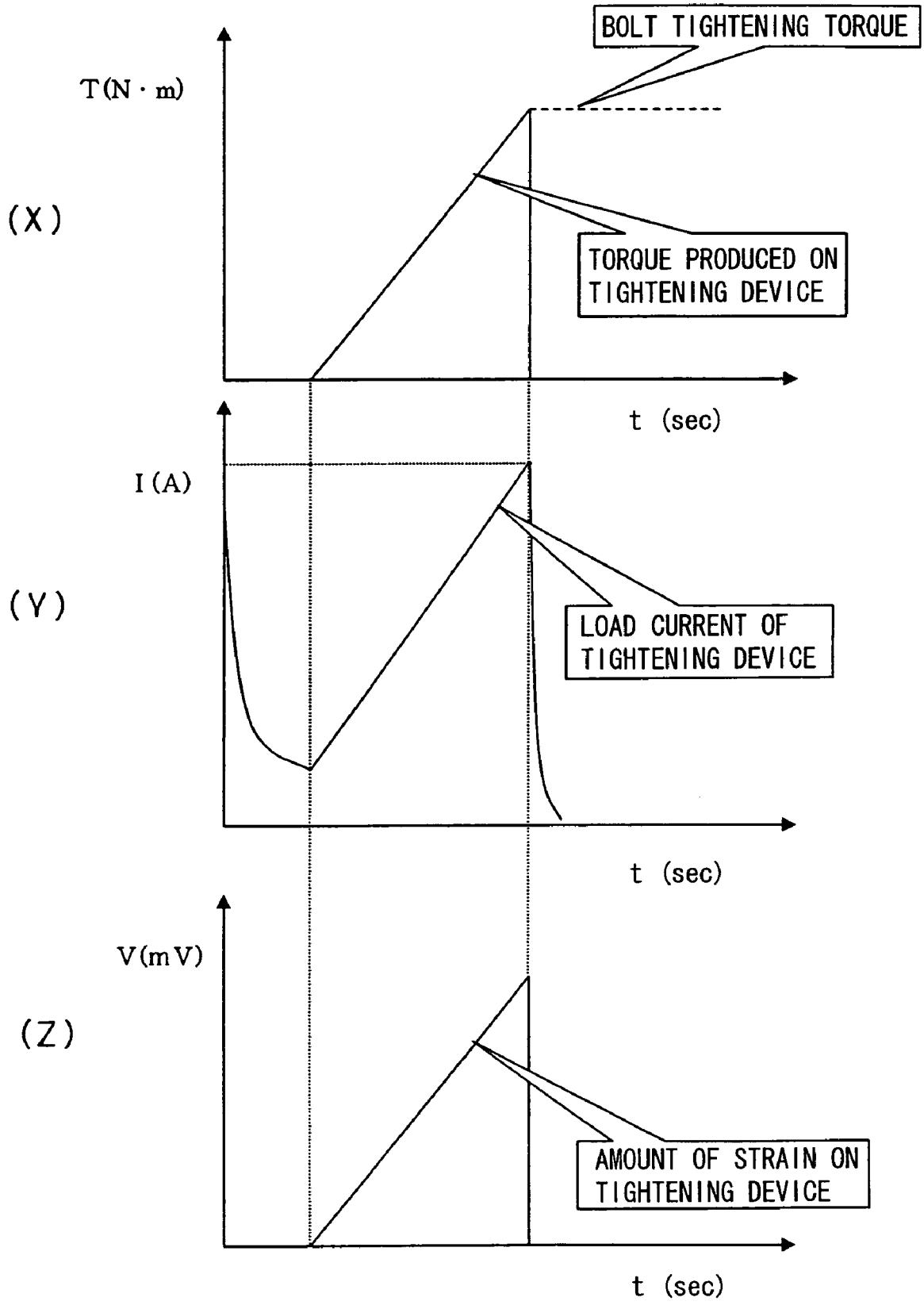
FIG. 22 includes graphs showing the relationships between the tightening torque, load current and amount of strain.

FIG. 22 shows the relationships between the torque produced in the tightening device during tightening, the amount of strain of the tightening device (more specifically the strain on the outer shaft 32 of unit main body 3 of the torque measuring unit 4) and the load current through the tightening device. When the tightening device is initiated into operation, starting to tighten a bolt, the torque (bolt tightening torque) produced by the device gradually increases, and the load current of the device also gradually increases in proportion to the increase in torque.

When the bolt is given a specified torque value, and the tightening device is deenergized, the torque given to the bolt is maintained as it is (see the broken line in FIG. 22), while the torque produced by the tightening device, and the load current decrease markedly. Accordingly, the amount of strain on the torque measuring unit in proportion to the torque produced by the tightening device greatly decreases. Thus, there is no need to detect the amount of strain after the bolt is tightened until the next bolt is tightened.

The present applicant conceived the idea of deenergizing the strain sensor circuit after a peak of tightening torque is held by the measuring unit 4, and turning on LEDs of the indicator 5 only when required to eliminate useless current consumption and lengthen the life of the battery V incorporated in the measuring unit 4. The applicant also made it possible to manipulate the control circuit on the circuit board 7, 71 of the measuring unit 4 with one push-button switch 6 and to diminish the space for providing the switch 6 on the circuit board 7.

Usually, the control circuit requires at least two manual switches, i.e., a power source switch and a set (reset) switch. In the case of a control circuit including a CPU, it is necessary to hold the CPU power source on (standby power) at all times, or a set switch must be depressed after the power source is turn on. Otherwise, the CPU in set condition [bridge power source on plus auto zero (to be described later)] can not be recognized. However, if two or more switches are mounted on the circuit board 7, this increases the number of components, also increasing the area of the circuit board 7. Further if the CPU power source is held on at all times, the battery will be consumed to a greater extent.

According to the present embodiment, therefore, a self-holding circuit is provided as hardware outside the CPU, such that while the push-button switch 6 is on, the CPU is energized, and at the same time, the CPU is caused to output a self-holding command to hold the CPU energized even if the switch is turned off. At the same time, an input port for recognizing on/off state of the push-button switch 6 is provided, and when the push-button switch 6 is turned on, a switch actuation signal is input to this port for the switch 6 to actuate power supply and also setting.

For the push-button switch 6 to serve as a power source on/off switch and also as a set switch, the two switch functions are discriminated according to the difference in the duration of a push of the switch 6 (period of time the push-button switch is held on). According to the embodiment, the power source is turned on by a long push of the switch for at least 1 second. Setting is effected by a short push of the switch for less than 1 second (at least the shortest period of time recognizable by the CPU). While the power source is on by virtue of self-holding, a short push of the switch effects setting.

The power source is turned off by a long push of at least 3 seconds, whereby the self-holding circuit is deactivated. Upon the release of the push-button switch from the hand, all power sources (including the CPU power source) are turned off. The power source is turned on by 1-second push, or is turned off by 3-second push, as distinguished from setting by a short push. This mode of switching action has another advantage that the turning on or off of the power source by an error is avoidable.

Figure 20:
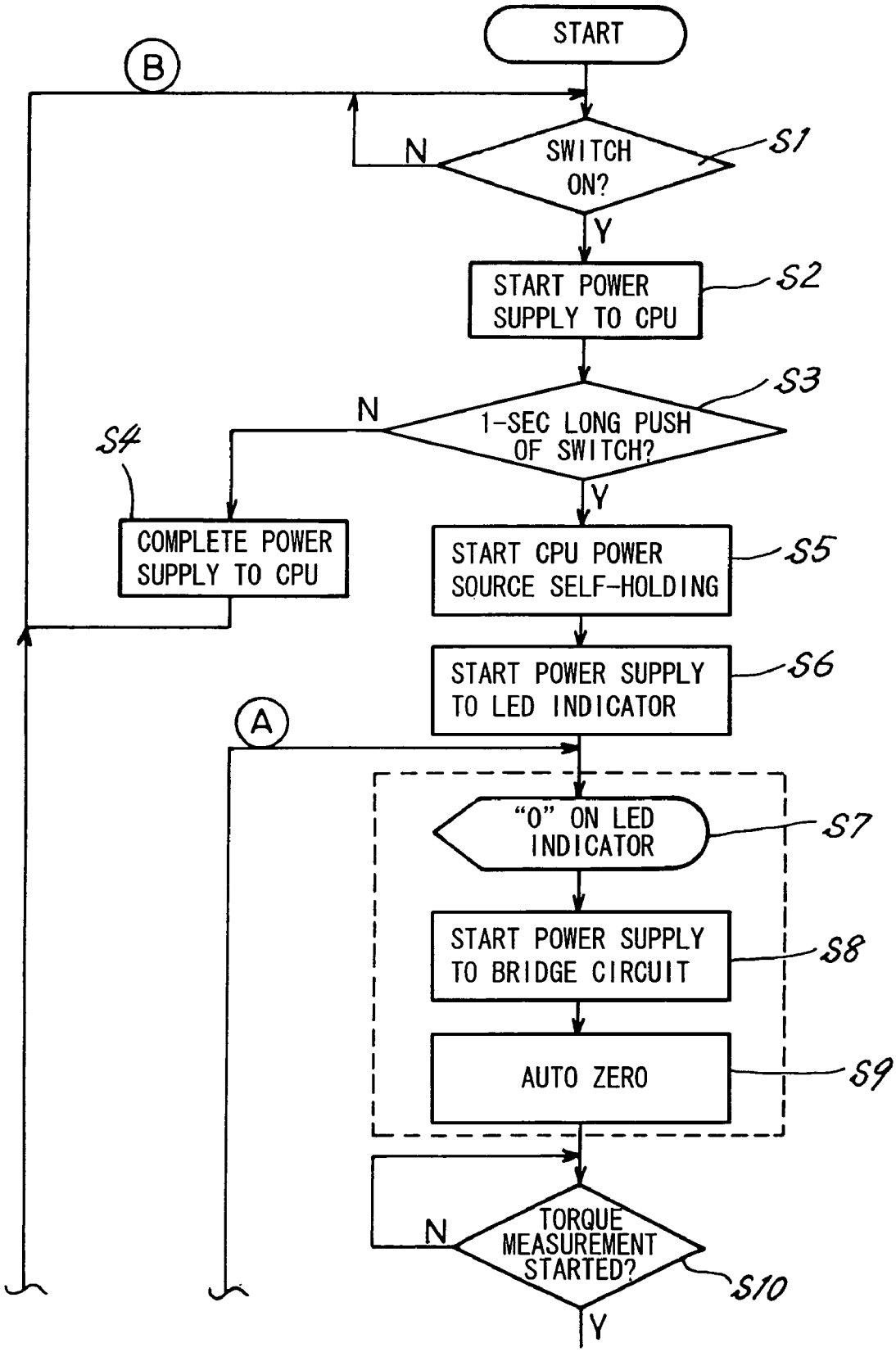
FIG. 20 is a diagram showing the first half of an operation flow chart.
Figure 21:
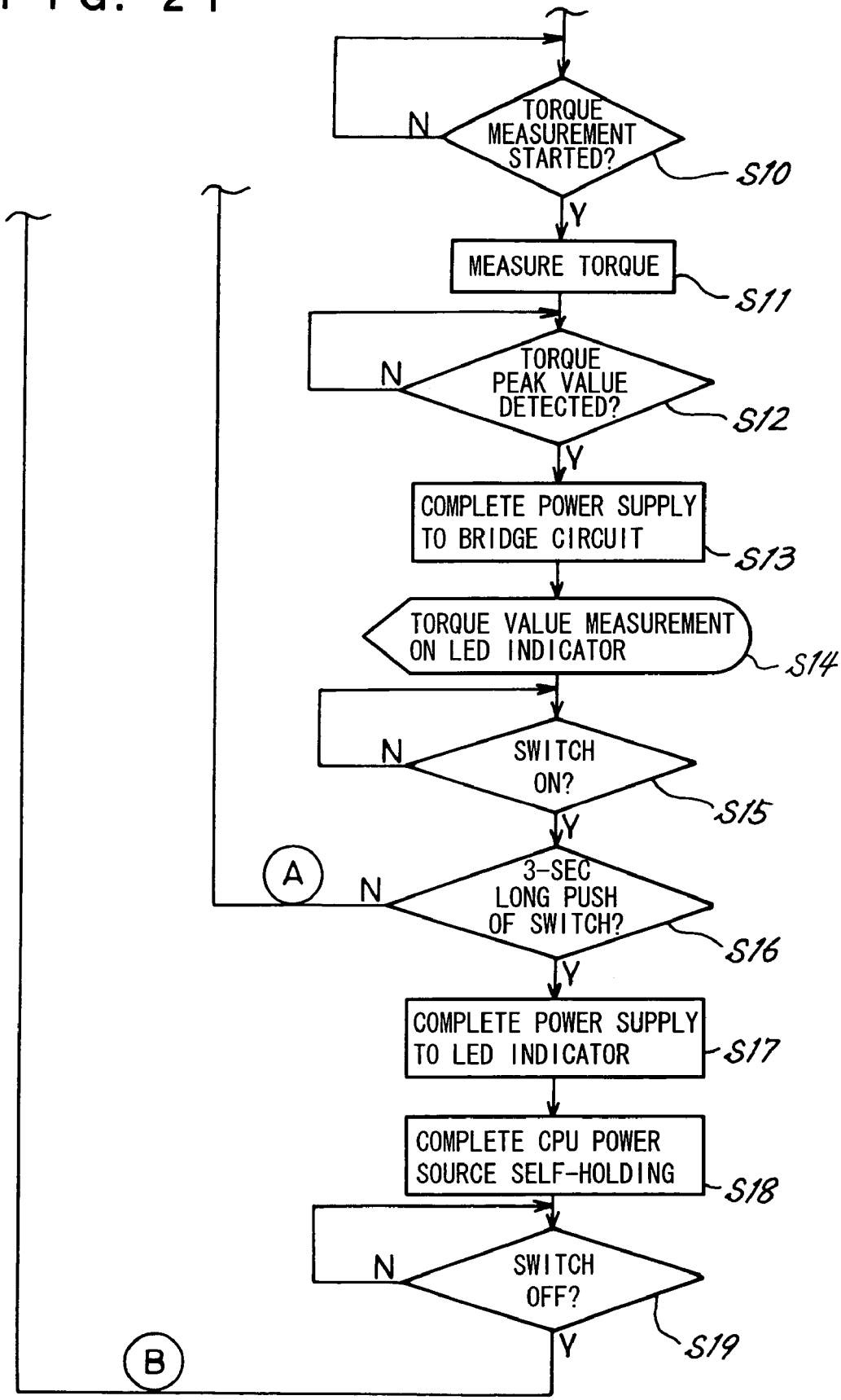
FIG. 21 is a diagram showing the second half of the operation flow chart.

FIGS. 20 and 21 show a flow chart of the operation of the control circuit.

Step 1 following the start inquires whether the push-button switch 6 is pushed. If the answer is negative, step 1 is repeated. When the answer is affirmative, step 2 (S2) follows to start supply of power to the CPU on the circuit board 7.

The start of power supply to the CPU is followed by step 3 (S3) to inquire whether the duration of depression of the switch 6 is a least 1 second. When the inquiry is answered in the negative, the sequence proceeds to step 4 (S4), wherein the power supply to the CPU is completed, and the sequence returns to a stage immediately before step 1. When the answer is affirmative, step 5 (S5) follows, in which the CPU power source is self-held. Supply of power to LEDs of the indicator 5 is started in step 6 (S6).

The sequence then proceeds to data setting. In step 7 (S7), the indicator 5 shows "0" for one digit only, with the other digits all turned off. Power supply is started in step 8 (S8) to the bridge circuit of strain gauges 47 and to an analog amplification circuit for amplifying the signal from this circuit. With as light time lag, step 9 (S9) stores in a memory a digital value as converted from an analog value of voltage output from the bridge circuit of strain gauges 47 at the time of torque zero. A value obtained by subtracting this value and converted to a torque value is displayed to execute "auto zero." The step of auto zero (S9) is generally performed in torque measuring devices, and is the function of automatically correcting variations, due to disturbances, for example, of temperature, in the output voltage value from the bridge of strain gauges 47.

An inquiry is made in the next step 10 (S10) as to whether the tightening torque is in excess of the desired tightening torque. If the answer is negative, the sequence returns to a stage immediately before step 10 (S10). When the answer is affirmative, torque is measured in step 11 (S11), and the indicator 5 shows a gradually increasing tightening torque value. The suitable level at which this torque measurement is started appears to be about 10% of the rated torque of the tightening device main body 1, while the level is preferably close to zero if errors in operation are avoidable.

An inquiry is made in the subsequent step 12 (S12) as to whether a torque peak value is detected. When the inquiry is answered in the negative, the sequence returns to a stage immediately before step 12 (S12). If the answer is affirmative, the supply of power to the bridge circuit is completed in step 13 (S13). The indicator 5 is held in the state showing the peak value.

Next, step 5 (S15) inquires whether the push-button switch 6 is pushed. If the answer is affirmative, the sequence returns to a stage immediately before step 15.

If the answer of step 15 is affirmative, step 16 (S16) follows to inquire whether the push-button switch is held pushed for at least 3 seconds. When the answer is negative, the sequence returns to a stage immediately before step 7 in preparation for the subsequent torque measurement.

When the answer to the inquiry of step 16 (S16) is affirmative, the supply of power to the indicator 5 is completed in step 17 (S17).

Self-holding of the CPU power source is completed subsequently in step 18 (S18), followed by step 19 (S19) to inquire whether the push-button switch 6 is released from pressure. When the answer is negative, the sequence returns to a stage immediately before step 19, while if the answer is affirmative, the sequence returns to a stage immediately before step S1.

The supply of power to the bridge of strain gauges 47 is limited to a period of time required for measurement as described above, whereby the consumption of battery V is suppressed, while the production of Joule heat due to the current passed through the bridge of strain gauges 47 can be minimized. When the push-button switch 6 is "held pushed for at least 1 second" while the CPU power source is not self-held, the power source is turned on, and the auto zero function is also activated.

A push of the switch 6 "for less than 3 seconds" activates the auto zero function for the second and following torque measuring procedures. A push of the switch 6 "for at least 3 seconds" turns off the power source when the CPU power source is self-held. Thus, the single push-button switch serves the functions of three kinds of switches. This diminishes the area required for the arrangement of three switches and obviates errors to be involved in pushing three switches.

Although 1 second and 3 seconds are referred to above as the criteria for discriminating the duration of depression of the push-button switch 6, these periods of depression are of course not limitative; a desired period of time can be set for pushing the switch if the above-specified period appears too short or too long to the worker.

The foregoing embodiments are so designed that the socket unit 2 is removably attached to the tightening device main body 1 and subsequently removed from the device main body 1 after setting the tightening torque, whereas the bolt or nut can of course be tightened with the socket unit 2 attached to the device main body.

Figure 23:
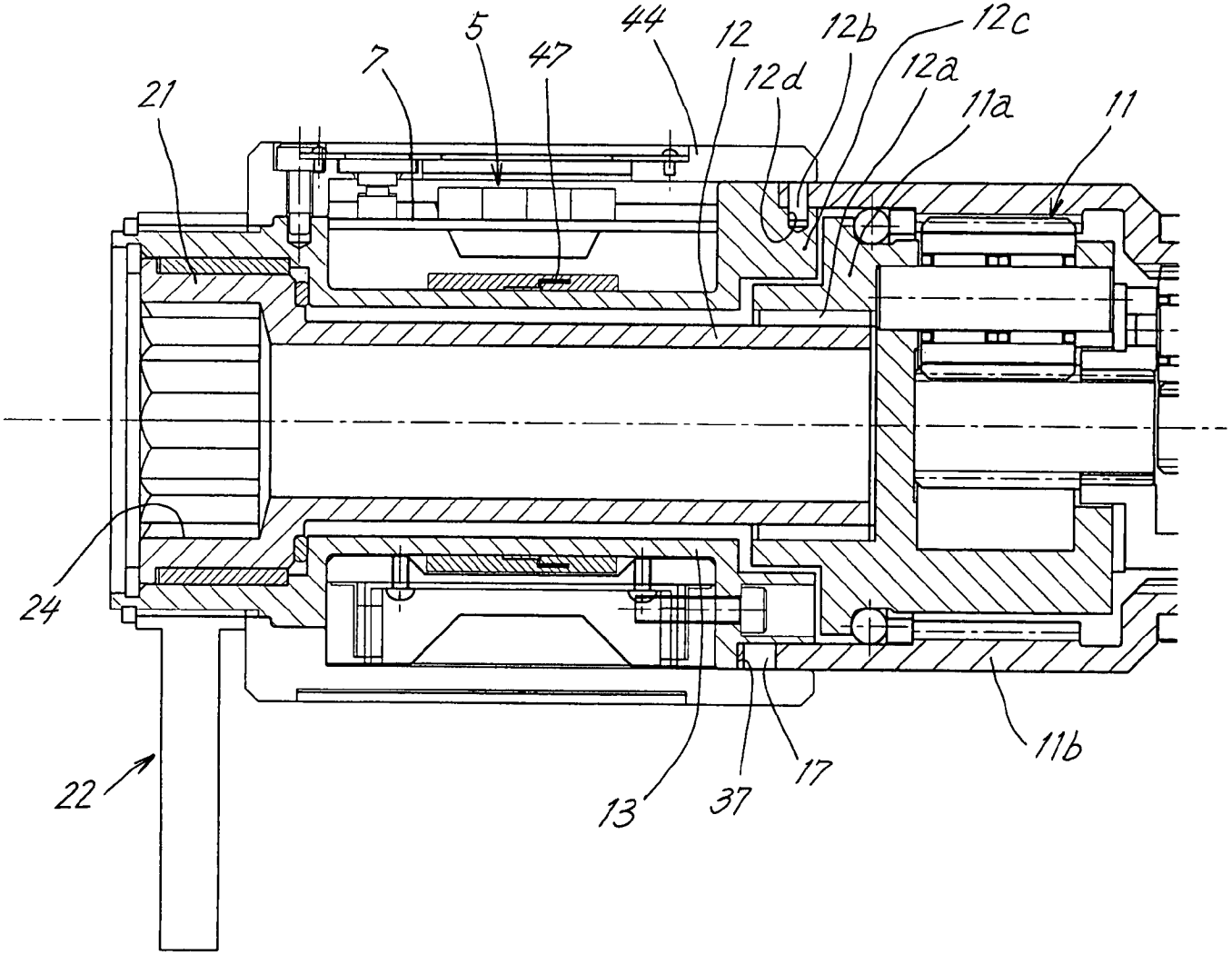
FIG. 23 is a fragmentary sectional view showing another embodiment of torque indicating tightening device.

With reference to FIG. 23, a torque indicating tightening device will be described below in which strain gauges 47 are affixed to the output shaft of the device.

A planetary gear reduction mechanism 11 of the tightening device has a planetary gear support frame 11*a*, which is provided with a first output shaft 12. An internal gear 11*b* of the mechanism 11 is provided with a second output shaft 13.

The first output shaft 12 may be integral with the support frame 11*a*, or may be splined as at 12*a* to the support frame 11*a* so as to be rotatable therewith.

The second output shaft 13 may be integral with the internal gear 11*b*, or may be connected to the internal gear 11*b* so as to be rotatable therewith, with projections 17 on an end edge of the gear 11*b* engaged in cutouts 37 formed in the second output shaft 13.

The first output shaft 12 has at its outer end a tightening socket 21 having a nut engaging cavity 24. the second output shaft 12 has a reaction force receiver 22 at its outer end.

The reaction force receiver 22 may be integral with the second output shaft 13, but is made separate from the shaft 13 according to the embodiment in view of the ease of assembling and also in view of the replacement of the receiver 22 which is liable to break. The reaction force receiver 22 is attached to the second output shaft 13 by the same coupling structure as the outer shaft 32 of the torque measuring unit 4 of the fourth embodiment and the reaction force receiver 22.

The second output shaft 13 has strain gauges 47, circuit board 7, indicator 5 and battery 7 (not shown) which are mounted thereon in the same manner as the strain gauges 47, circuit board 7, indicator 5 and battery (not shown) on the outer shaft 32.

The internal gear 11*b* and the second output shaft 13 are prevented from slipping off by a pin 12*b* extending through an outer end portion of the internal gear 11*b*, orthogonal to the axis of the gear 11*b* and fitted in a cavity, circumferential groove or like recess 12*d* which is formed in the second output shaft 13 at the portion 12*c* thereof fitting to the outer end of the gear 11*b*.

The outer end portion of the internal gear 11*b* is covered with an end portion of a tubular case 44 covering the circuit board 7, etc. so as to conceal the pin 12*b*. The pin 12*b* therefore will not slip off.

In the case of the tightening device shown in FIG. 23 and described, the first output shaft 12 is not integral with the planetary gear support frame 11*a*, and the second output shaft 13 is not integral with the internal gear 11*b*, so that the embodiment is almost similar to the embodiment shown in FIGS. 14, 15 and 16. The present embodiment is herein described with reference to FIG. 23 in order to avoid the misunderstanding that the attachment of the torque measuring unit 4 to the device main body 1 is an essential feature of the present invention.

The description given above is intended to illustrate the present invention and not intended to limit the invention as set forth in the appended claims or to reduce the scope thereof. The unit and the device of the invention are not limited to the foregoing embodiments in construction but can of course be modified variously within the technical scope set forth in the claims.

Although the tightening sockets 21 of the embodiments have a nut engaging cavity at one end, this construction is not limitative; when the socket end has a recess or polygonal rod fittable to the bolt or nut to be tightened, such as a hexagonal rod engageable in an internal hexagon-shaped socket in the head of a bolt, such a socket is of course included in the tightening sockets 21.

The torque measuring units 4 of the embodiments have not only strain gauges 47 but also the circuit board 7 and indicator 5 on the outer shaft 32, the circuit board 7 and the indicator 5 can alternatively be provided on a suitable portion of the tightening device or at a suitable location away from the device. When it is difficult to connect the strain gauges 47 to the circuit board 7 or indicator 6 with wiring, signals may be transmitted wirelessly.

What is claimed is:

1. A tightening torque measuring unit for measuring the tightening torque of a bolt or nut tightening device, the bolt or nut tightening device having a device main body comprising a first output shaft and a second output shaft which are rotatable in directions opposite to each other and coaxially arranged, the tightening torque measuring unit having an inner shaft connectable to the first output shaft of the device main body and an outer shaft connectable to the second output shaft, the inner shaft being provided at an outer end thereof with one of a tightening socket and a reaction force receiver, the outer shaft being provided at an outer end thereof with the other of the socket and the receiver, the outer shaft having a strain gauge thereon, the tightening torque measuring unit further comprising a circuit board for converting an amount of strain detected by the strain gauge into a corresponding tightening torque value and an indicator for indicating the tightening torque value, and the tightening torque measuring unit being removably connectable to the device main body.

2. The tightening torque measuring unit according to claim 1 which comprises a unit main body including the inner shaft and the outer shaft, and a socket unit removably connected to the unit main body, the socket unit comprising the reaction force receiver composed of a tubular member and a reaction force receiving arm, and the tightening socket rotatably fitting in the tubular member of the reaction force receiver.

3. The tightening torque measuring unit according to claim 2 wherein the first and second output shafts of the device main body are connected respectively to the inner and outer shafts of the unit main body and the inner and outer shafts of the unit main body are connected respectively to the tightening socket and the reaction force receiver by fitting projections into recessed portions, the projections being engageable with or disengageable from the recessed portions in a direction along an axis of the tightening torque measuring unit.

4. A bolt or nut tightening device comprising the tightening torque measuring unit according to claim 2.

5. The tightening torque measuring unit according to claim 1 wherein the tightening socket is removably attached to a square rod projecting from the outer end of the inner shaft, and the reaction receiver is removably attached to the outer shaft.

6. The tightening torque measuring unit according to claim 1 wherein the outer shaft is provided with two circumferential walls spaced apart from each other and has the strain gauge affixed thereto between the circumferential walls, and the indicator, the circuit board, a push-button switch and a battery are arranged between the circumferential walls and covered with a tubular case fitted around the outer shaft and interconnecting the circumferential walls, the indicator and the push-button switch being positioned in corresponding relation with an window formed in the case.

7. The tightening torque measuring unit according to claim 1 wherein the strain gauge is provided on the outer shaft at each of portions thereof which are a multiple of 2 in number and positioned at approximately equal intervals circumferentially of the outer shaft.

8. The tightening torque measuring unit according to claim 1 wherein a control circuit is operable by pushing the single push-button switch for long and short periods of time.

9. The tightening torque measuring unit according to claim 1 wherein the circuit board has the function of interrupting the supply of power to a strain gauge bridge circuit and an analog amplification circuit after measuring bolt or nut tightening torque until an auto zero procedure before the subsequent tightening torque measurement.

10. The tightening torque measuring unit according to claim 1 wherein the circuit board and the indicator are arranged on the outer shaft.

11. The tightening torque measuring unit according to claim 1 wherein the outer end of the inner shaft is formed as a tightening socket and the reaction force receiver is attached to the outer end of the outer shaft.

12. The tightening torque measuring unit according to claim 11 wherein the inner shaft is removably received within the outer shaft to be replaceable by another inner shaft having a nut engaging cavity of different size.

13. A bolt or nut tightening device comprising the tighting torque measuring unit according to claim 1.

* * * * *